US011692775B2

(12) United States Patent
Garot et al.

(10) Patent No.: US 11,692,775 B2
(45) **Date of Patent: *Jul. 4, 2023**

(54) REFRACTORY ANCHOR(S), SYSTEMS AND METHODS OF USE

(71) Applicant: Silicon Holding B.V., Wateringen (NL)

(72) Inventors: Jerome Michael Garot, Wateringen (NL); Danielle Francesca Garot, Wateringen (NL); Wouter Garot, Wateringen (NL)

(73) Assignee: Silicon Holding B.V., Wateringen (NL)

( * ) Notice: Subject to any disclaimer, the term of this patent is extended or adjusted under 35 U.S.C. 154(b) by 0 days.

This patent is subject to a terminal disclaimer.

(21) Appl. No.: 17/953,661

(22) Filed: Sep. 27, 2022

(65) Prior Publication Data

US 2023/0117759 A1 Apr. 20, 2023

Related U.S. Application Data

(63) Continuation of application No. 17/536,425, filed on Nov. 29, 2021, now Pat. No. 11,486,643.

(60) Provisional application No. 63/255,494, filed on Oct. 14, 2021.

(51) Int. Cl.
*F27D 1/14* (2006.01)
*F27D 1/16* (2006.01)

(52) U.S. Cl.
CPC ..... *F27D 1/142* (2013.01); *F27D 1/16* (2013.01)

(58) Field of Classification Search
USPC ..... 52/334, 378, 443
See application file for complete search history.

(56) References Cited

U.S. PATENT DOCUMENTS 4,711,186 A * 12/1987 Chen ..... B04C 5/085 52/378
D393,588 S * 4/1998 Tuthill ..... D8/384
6,393,789 B1 5/2002 Lanclos
9,861,949 B2 * 1/2018 Simon ..... F23M 5/04
10,352,619 B2 * 7/2019 Yoder ..... B01J 19/0053
10,508,861 B1 * 12/2019 D'Oracio De Almeida ..... F27D 1/142
D872,569 S * 1/2020 D'Oracio De Almeida .. D8/384
(Continued)

FOREIGN PATENT DOCUMENTS

NL 2023011 B1 11/2020

OTHER PUBLICATIONS

International Search Report and Written Opinion for PCT/EP2022/078366 dated Feb. 14, 2023 (11 pages).

*Primary Examiner* — Joshua K Ihezie
(74) *Attorney, Agent, or Firm* — Shumaker, Loop & Kendrick, LLP

(57) ABSTRACT

A refractory anchor for lining a thermal vessel including (a) a mounting element positioned in the center of the refractory anchor that is adapted for mounting the refractory anchor to the thermal vessel; (b) two three-anchor fin arrangements that are each directly connected to the mounting element by a first anchor fin positioned in each three-anchor fin arrangement, wherein each three-anchor fin arrangement is positioned on opposite sides of the mounting element relative to one another such that the first anchor fins of each three-anchor fin arrangement are angled (α) relative to one another; and (c) optionally a reinforcement fin connected to and extending away from one of the three-anchor fin arrangements.

24 Claims, 38 Drawing Sheets

(56) References Cited

U.S. PATENT DOCUMENTS

| | | | | |
|---|---|---|---|---|
| 10,907,899 | B1 * | 2/2021 | Lanclos | F27D 1/141 |
| 10,982,903 | B2 | 4/2021 | D'Oracio De Almeida et al. | |
| 2018/0345401 | A1 * | 12/2018 | Giaramita | F27D 1/141 |
| 2022/0205720 | A1 | 6/2022 | Garot et al. | |

* cited by examiner

100

REFRACTORY ANCHOR(S), SYSTEMS AND METHODS OF USE

TECHNICAL FIELD

The present invention relates generally to the field of refractory anchors, anchor assemblies, and linings for thermal vessels, and more particularly, to refractory anchors having two three-anchor fin arrangements connected to a mounting element in which the three-anchor fin arrangements are angled relative to one another. When compared with conventional anchors, these refractory anchors are configured for improved flow and homogeneous dispersion of the liner material during application of the liner material, which advantageously leads to longer lifespan and use of the thermal vessel.

BACKGROUND

Thermal vessels are used in chemical and petrochemical refining and processes. These vessels are frequently subjected to harsh conditions (e.g., high-temperature and harsh pH environments and frequent movement of solid and semi-solid abrasive materials contained within the vessels), which may further weaken these vessels thereby decreasing vessel lifespan. To combat these harsh conditions and increase lifespan of these vessels, the inside walls of these vessels are frequently reinforced with refractory anchors/anchor assemblies arranged in a predetermined pattern that are further coated with a liner material. Generally speaking, two categories of refractory anchors and anchoring assemblies exist. In particular, those that are mounted on a metal object before liner material in liquid form is applied, and those that are pre-installed in cured liner material. Both categories comprise a variety of different types of anchor assemblies, all of which transfer loads from the anchor assembly to the cured liner material in a variety of ways, which at least depends on the actual design of the anchor assemblies.

The above-mentioned loads are considered to be either static or dynamic. Static loads comprise, for example, tension, shear, or a combination of both. Dynamic loads on the other hand comprise, for example, seismic, fatigue, wind and/or shock. The design of an anchor assembly determines whether it is suitable or unsuitable for the above-mentioned load types.

Several techniques are known in the art to transfer the load, such as keying, friction and bonding techniques. Keying, for example, is considered to be the direct transfer of a load from the anchor assembly into the cured liner material by bearing forces in a same direction of loading the anchor assembly.

Friction is based on transferring a load through friction between expansion sleeves of the anchor assembly and the wall of the drilled hole in the concrete. The effect is similar as is reached by a standard plug in a wall. Finally, bonding takes place when resins or grouts are used around the anchor, which is usually the case with post-installed anchor assemblies.

U.S. Pat. No. 6,393,789 generally discloses conventional refractory anchor assemblies that are mounted on a metal object within, for example, a thermal vessel before liner material is applied. These assemblies are generally cumbersome to assemble because they require clamping or crimping tools to assemble each refractory anchor. Thus, assembling each refractory anchor disclosed in U.S. Pat. No. 6,393,789 is time consuming and laborious—leading to increased installation time(s) even before application of the liner material.

After installation of the above mentioned conventional refractory anchors/anchor assemblies in a desired pattern in the thermal vessel, further problems arise during application of the liner material, during curing of the liner material, and/or post-curing of the liner material while the vessel is in use. These problems are related to the structural features of these anchors and anchor assemblies in U.S. Pat. No. 6,393,789 (as well as other anchors and anchor assemblies known in the art having similar features). In particular, because (1) the outermost peripheral edges that form the upper surface completely reside in the same plane (e.g., a plane that is horizontal to the longitudinal axis of the anchor), (2) the outermost peripheral edges that form the lower surface reside substantially in the same plane (e.g., a plane that is horizontal to the longitudinal axis of the anchor), and (3) the outermost edges of each fin reside in the same plane (e.g., a plane that is transverse/perpendicular to the longitudinal axis of the anchor), the likelihood of liner cracking or biscuiting is increased because the configuration of the above mentioned outermost peripheral edges impedes liner material flow and dispersion during application of the liner material, which ultimately leads to heterogeneous and uneven application and curing of the liner material. Furthermore, air micropockets may form between the interface of the anchor and liner material due to heterogeneous and uneven application of the liner material resulting from the above-mentioned structural features of conventional refractory anchors, which further leads to the increased likelihood of premature liner cracking and/or biscuiting within the thermal vessel.

Moreover and with specific reference to outermost peripheral edges that form the upper surface of the refractory anchors depicted in U.S. Pat. No. 6,393,789, the upper surface of the refractory anchors remain exposed post-curing of the liner material and subsequently while the thermal vessel is in use. While the thermal vessel is in use, the upper surface of the anchor as well as the liner (i.e., cured liner material) are exposed to solids moving at high speeds in an abrasive environment. The liner material has a relatively high abrasion resistance especially when compared to the anchor. Because of the differences in abrasion resistance between the liner and the upper surface of the refractory anchor (such as those depicted in U.S. Pat. No. 6,393,789 and/or having outermost peripheral edges that form the upper surface of the refractory anchors that completely reside in the same plane), the anchors, and more particularly the exposed portions of the anchors in the upper surface thereof, are more prone to corrode over time than the liner, which further leads to liner cracking and overall weakening of the thermal vessel liner due to disassociation of the anchor from the liner.

SUMMARY

It is an object of the invention to provide refractory anchors that cure the above-mentioned problems. In particular, it is an object to provide refractory anchors configured for increased and/or improved dispersion of the liner material during application and subsequent curing of the liner material while concurrently reducing the likelihood of micropocket formation (e.g., air micropocket formation) and/or macropocket formation (e.g., air macropocket formation) between the refractory anchor and liner interface. The particular structural features (external voids, external grooves, and internal openings) of the anchors as disclosed herein further facilitate and achieve the increased and/or improved liner dispersion, thus reducing the likelihood of premature liner cracking and/or biscuiting while the thermal vessel is in use. Moreover, the refractory anchors disclosed herein provide improved abrasion resistance of the thermal vessel liner due to the unique structural features of the refractory anchor's upper surface. Improved abrasion resistance is achieved because portions of the upper surface of the refractory anchor reside in different planes (i.e., certain portions of the refractory anchor's upper surface are recessed relative to other portions of the upper surface). When the liner material is applied and subsequently cured, the overall exposed surface area of the upper surface of the disclosed anchor is greatly reduced when compared to conventional refractory anchors because the entire upper surface of the disclosed refractory anchor does not reside in the same or substantially the same plane. By reducing the overall exposed surface area of the upper surface of the anchors disclosed herein, the total upper surface of the anchor exposed to an abrasive environment while the thermal vessel is in use is greatly reduced, which advantageously leads to reduced corrosion of the refractory anchor, reduced disassociation of the refractory anchor from the liner associated with refractory anchor corrosion, and increased liner lifespan as well as increased use of the thermal vessel.

Disclosed herein are refractory anchors for lining a thermal vessel including: (a) a mounting element positioned in the center of the refractory anchor that is adapted for mounting the refractory anchor to the thermal vessel; (b) at least two three-anchor fin arrangements that are each directly connected to the mounting element by a first anchor fin positioned in each three-anchor fin arrangement, wherein each three-anchor fin arrangement is positioned on opposite sides of the mounting element relative to one another such that the first anchor fins of each three-anchor fin arrangement are angled ($\alpha$) relative to one another; and (c) optionally a reinforcement fin (also referred to as reinforcement segment) connected to and extending away from one of the three-anchor fin arrangements.

In certain aspects, each three-anchor fin arrangement includes a center portion connected to the first anchor fin, a second anchor fin, and a third anchor fin. In certain aspects, each anchor fin (i.e., the first, second, and third anchor fins of each three-anchor fin arrangement) are substantially the same length.

In certain aspects, the first anchor fin, the second anchor fin, and the third anchor fin of each three-anchor fin arrangement radially extend away from the center portion in its respective three-anchor fin arrangement.

In certain aspects, the first anchor fin in each three-anchor fin arrangement is positioned between and directly connected to the mounting element and the center portion of the respective three-anchor fin arrangement.

In certain aspects, outermost peripheral edges of the mounting element and outermost peripheral edges of the two three-anchor fin arrangements define an upper surface and lower surface of the refractory anchor as well as outermost side surfaces of the second anchor fin and the third anchor fin in each three-anchor fin arrangement.

In certain aspects, the outermost peripheral edges of the mounting element and/or the outermost peripheral edges of the two three-anchor fin arrangements define external grooves and/or external voids in one of: the upper surface of the refractory anchor, the lower surface of the refractory anchor, and/or the outermost side surfaces of the second anchor fin and/or the third anchor fin in each three-anchor fin arrangement.

In certain aspects, the external grooves and/or external voids defined by the outermost peripheral edges of the mounting element and/or the outermost peripheral edges of the two three-anchor fin arrangements are configured to facilitate flow and dispersion (i.e., improve flow and facilitate more homogenous dispersion) of liner material during application of the liner material in the thermal vessel while the refractory anchor is in use.

In certain aspects, external grooves and/or external voids are present in the upper surface of the refractory anchor device such that portions of the upper surface of the of the refractory anchor device are present in different planes (e.g., different horizontal planes relative to the longitudinal axis of the refractory anchor) and are configured to facilitate flow and dispersion (i.e., improve flow and facilitate more homogenous dispersion) of liner material during application of the liner material in the thermal vessel while the refractory anchor is in use.

In certain aspects, external grooves and/or external voids are present in the lower surface of the refractory anchor device such that portions of the lower surface of the of the refractory anchor device are present in different planes (e.g., different horizontal planes relative to the longitudinal axis of the refractory anchor) and are configured to facilitate flow and dispersion (i.e., improve flow and facilitate more homogenous dispersion) of liner material during application of the liner material in the thermal vessel while the refractory anchor is in use.

In certain aspects, the external grooves and/or external voids are present in the outermost side surfaces of the second anchor fin and/or the third anchor fin in each three-anchor fin arrangement such that portions of outermost side surfaces of the second anchor fin and/or the third anchor fin in each three-anchor fin arrangement of the refractory anchor device are present in different planes (e.g., vertical planes relative to the longitudinal axis of the refractory anchor) and are configured to facilitate flow and dispersion of liner material during application of the liner material in the thermal vessel while the refractory anchor is in use.

In certain aspects, one to six reinforcement segments are positioned in the refractory anchor device in between the upper and lower surfaces of the refractory anchor device. In this aspect, each reinforcement segment is shorter in length than a length of each anchor fin in the two three-anchor fin arrangements.

In certain aspects, each reinforcement segment of the one to six reinforcement segments is directly connected to and extends away from one of the two three-anchor fin arrangements.

In certain aspects, each reinforcement segment is positioned on a different fin of the two three-anchor fin arrangements.

In certain aspects, the refractory anchor further comprises an internal opening immediately adjacent to at least one reinforcement segment, wherein the internal opening is formed within and defined by internal peripheral edges of the second anchor fin and/or the third fin of the two three-anchor fin arrangements.

In certain aspects, the internal opening immediately adjacent to the at least one reinforcement segment is configured to facilitate flow and dispersion (i.e., improve flow and facilitate more homogenous dispersion) of liner material during application of the liner material in the thermal vessel while the refractory anchor is in use In certain aspects, a semi-hexagonal shape is formed by a combination of the first anchor fin and another anchor fin in the first three-anchor fin arrangement and by the first anchor fin and another anchor fin in the second three-anchor fin arrangement.

In certain aspects, the refractory anchor includes only one semi-hexagonal shape formed by the two three-anchor fin arrangements.

In certain aspects, the refractory anchor device further comprises a mounting pin connected to the mounting element. In certain aspects, each component (e.g., the mounting element, the two-three anchor fin arrangements, the reinforcement fins/segments (when present) and mounting pin) of the refractory anchor device comprises a metal or metal alloy. In certain aspects, each component of the refractory anchor comprises the same metal or metal alloy. In certain aspects, various components of the refractory anchor comprise different metals or metal alloys. For example, the mounting pin may comprise a different metal or metal alloy than the mounting element, the two-three anchor fin arrangements, the reinforcement fins/segments to improve, vary, and/or tailor specific welding properties of the mounting pin to the mounting element when the refractory anchors are provided as separate components/assemblies. In yet further aspects, the mounting pin comprises either a metal or metal alloy while the remaining portions of the refractory anchor/refractory anchor device (e.g., the mounting element, the three anchor fin arrangements, reinforcement fins/segments (when present) or any combination thereof) comprise a non-ferrous material such as ceramics or silicon carbide.

In certain aspects, the two three-anchor fin arrangements are positioned such that the first anchor fins in each three-anchor fin arrangement are angled ($\alpha$) at an angle ranging from 105° to 130° relative to one another.

In certain aspects, the refractory anchor is monobloc.

In certain aspects, the anchoring device includes no clinching mechanisms to fasten multiple parts together.

In certain aspects, the refractory anchor is an assembly.

In certain aspects, a plurality of refractory anchors are arranged in a tessellated pattern. In this aspect, the tessellated pattern is a honeycomb pattern. In certain aspects, the plurality of refractory anchors are arranged in a tessellated pattern having a plurality of cells, and in this aspects, the cells may have a predetermined shape in which the predetermined shape includes a hexagon or hexagon-like shape, a pentagon or pentagon-like shape, a hendecagon or hendecagon-like shape, a chevron or chevron-like shape, and/or any combination thereof.

Also disclosed herein is an anchoring system for a refractory material for lining a thermal vessel. The anchoring system includes a plurality of refractory anchors, the refractory anchors as discussed above, including a mounting element positioned in the center of the refractory anchor that is adapted for mounting the refractory anchor to the thermal vessel; two three-anchor fin arrangements that are each directly connected to the mounting element by a first anchor fin positioned in each three-anchor fin arrangement, wherein each three-anchor fin arrangement is positioned on opposite sides of the mounting element relative to one another such that the first anchor fins of each three-anchor fin arrangement are angled ($\alpha$) relative to one another; and optionally a reinforcement fin connected to and extending away from one of the three-anchor fin arrangements. The refractory anchors are arranged in an ordered array of substantially hexagonal cells in a tessellated pattern forming rows and columns.

In certain aspects, each hexagonal cell is part of a row and a column of the tessellated pattern, each row comprises a set of co-linear, adjacent hexagonal cells; and each column comprises a set of co-linear, spaced-apart hexagonal cells. In certain aspects, the tessellated pattern is a honeycomb pattern.

In certain aspects, adjacent rows of the tessellated pattern at least partially overlap one another. In other aspects, adjacent columns of the tessellated pattern at least partially overlap one another.

In certain aspects, (i) each of the three-anchor fin arrangements of each of the plurality of refractory anchors is arranged in a tessellated pattern forming three-anchor fin arrangement rows and three-anchor fin arrangement columns, (ii) the three-anchor fin arrangement rows comprising a set of co-linear, adjacent three-anchor fin arrangements, and (iii) the anchor arrangement columns comprising a set of co-linear, spaced-apart three-anchor fin arrangements.

In certain aspects, (i) each of the three-anchor fin arrangements is arranged in a tessellated pattern forming three-anchor fin arrangement rows and three-anchor fin arrangement columns, (ii) the three-anchor fin arrangement rows comprising a set of co-linear, adjacent three-anchor fin arrangements, and (iii) the anchor arrangement columns comprising a set of co-linear three-anchor fin arrangements from every-other, non-adjacent three-anchor fin arrangement row.

In certain aspects, each of the mounting elements are arranged in a diagonal tessellated pattern.

In certain aspects, each of the mounting elements are arranged in a zig-zag tessellated pattern parallel to the columns of the tessellated pattern of the refractory anchors.

In certain aspects, each of the mounting elements are arranged in a parallelogram tessellated pattern comprising a plurality of adjacent parallelograms.

In certain aspects, the plurality of adjacent parallelograms comprise similarly-oriented parallelograms, dissimilarly-oriented parallelograms, or both.

In certain aspects, each of the mounting elements are arranged in a rhomboid tessellated pattern comprising a plurality of adjacent rhomboids.

In certain aspects, the plurality of adjacent rhomboids comprise similarly-oriented rhomboids, dissimilarly-oriented rhomboids, or both.

In certain aspects, each hexagonal cell comprises at least three reinforcement fins extending from three-anchor fin arrangements into the hexagonal cell.

In certain aspects, substantially half of the plurality of hexagonal cells are two-opening cells formed by an arrangement of two refractory anchors proximate one another. In some such aspects, (i) a first of the two refractory anchors forms two sides of a hexagonal cell, (ii) a second of the two refractory anchors forms four sides of the hexagonal cell, and (iii) two openings are defined between the first refractory anchor and second refractory anchor. In other such aspects, a mounting element of the second of the two refractory anchors is disposed within the two-opening cell. In some such aspects, the two-opening cells form a diagonal tessellated pattern and/or a zig-zag tessellated pattern.

In certain aspects, substantially half of the plurality of hexagonal cells are three-opening cells formed by an arrangement of three refractory anchors proximate one another. In some aspects, (i) wherein a first of the three refractory anchors forms a first two sides of a three-opening cell, a second of the three refractory anchors forms a second two sides of the three-opening cell, and a third of the three refractory anchors forms a third two sides of the three-opening cell, and (ii) wherein a first of the three openings is defined between the first refractory anchor and the second refractory anchor, a second of the three openings is defined between the second refractory anchor and the third refractory anchor, and a third of the three openings is defined between the third refractory anchor and the first refractory anchor. In some such aspects, none of the three-opening cells has a mounting element within the three-opening cell. In some such aspects, the three-opening cells form a diagonal tessellated pattern and/or a zig-zag tessellated pattern.

In certain aspects, (i) substantially half of the plurality of hexagonal cells are two-opening cells formed by an arrangement of two refractory anchors proximate one another, and (ii) substantially half of the plurality of hexagonal cells are three-opening cells formed by an arrangement of three refractory anchors proximate one another.

In certain aspects, (i) the two-opening cells form a diagonal tessellated pattern and/or a zig-zag tessellated pattern, and (ii) the three-opening cells form a diagonal tessellated pattern and/or a zig-zag tessellated pattern.

According to certain aspects disclosed herein, an anchoring system for a refractory material for lining a thermal vessel includes a plurality of refractory anchors. Each refractory anchor includes (i) a mounting element positioned in the center of the refractory anchor that is adapted for mounting the refractory anchor to the thermal vessel; (ii) two three-anchor fin arrangements that are each directly connected to the mounting element by a first anchor fin positioned in each three-anchor fin arrangement, wherein each three-anchor fin arrangement is positioned on opposite sides of the mounting element relative to one another such that the first anchor fins of each three-anchor fin arrangement are angled ($\alpha$) relative to one another; and (iii) optionally a reinforcement fin connected to and extending away from one of the three-anchor fin arrangements. The refractory anchors are arranged in an ordered array of chevron cells in a tessellated pattern forming rows and columns.

In certain aspects, (i) each chevron cell is part of a row and a column of the tessellated pattern, (ii) each column comprises a set of co-linear, adjacent chevron cells, and (iii) each row comprises a set of co-linear, adjacent chevron cells.

In certain aspects, the chevron cells of adjacent columns of the tessellated pattern do not overlap.

In certain aspects, the chevron cells of adjacent rows of the tessellated pattern at least partially overlap one another.

In certain aspects, the chevron cells comprise two tail portions and a head portion, adjacent rows of the tessellated pattern at least partially overlap one another, and the two tail portions of the chevron cells of a lower row overlap the head portions of the chevron cells of an upper row adjacent the lower row.

In certain aspects, (i) each of the three-anchor fin arrangements is arranged in a tessellated pattern forming three-anchor fin arrangement rows and three-anchor fin arrangement columns, (ii) the three-anchor fin arrangement rows comprise sets of co-linear, adjacent three-anchor fin arrangements, and (iii) the three-anchor fin arrangement columns comprise sets of co-linear, adjacent three-anchor fin arrangements.

In certain aspects, each of the mounting elements are arranged in a diagonal tessellated pattern.

In certain aspects, the mounting elements are arranged in a zig-zag tessellated pattern comprising a plurality of zig-zags each parallel to the columns of the tessellated pattern of the refractory anchors.

In certain aspects, each of the mounting elements are arranged in a parallelogram tessellated pattern comprising a plurality of adjacent parallelograms. In some such aspects, the plurality of adjacent parallelograms comprise similarly-oriented parallelograms, dissimilarly-oriented parallelograms, or both.

In certain aspects, each of the mounting elements are arranged in a rhomboid tessellated pattern comprising a plurality of adjacent rhomboids. In some such aspects, the plurality of adjacent rhomboids comprise similarly-oriented rhomboids, dissimilarly-oriented rhomboids, or both.

In certain aspects, each of the mounting elements are arranged in a rectangular tessellated pattern comprising a plurality of similarly-oriented, adjacent rectangles.

In certain aspects, substantially half of the plurality of chevron cells are two-opening cells formed by an arrangement of two refractory anchors proximate one another. In some such aspects, (i) a first of the two refractory anchors forms two sides proximate a tail of a chevron cell, (ii) a second of the two refractory anchors forms four sides proximate a head of the chevron cell, and (iii) two openings are defined between the first and second refractory anchors. In some such aspects, a mounting element of the second of the two refractory anchors is disposed within the two-opening cell proximate the head of the chevron cell. In some such aspects, the two-opening cells form a parallelogram tessellated pattern, and/or a rectangular tessellated pattern.

In certain aspects, substantially all of the plurality of chevron cells are three-opening cells formed by an arrangement of three refractory anchors proximate one another. In some such aspects, (i) wherein a first of the three refractory anchors forms a first two sides proximate a tail of a chevron cell, a second of the three refractory anchors forms a second two sides of the chevron cell, and a third of the three refractory anchors forms a third two sides of the chevron cell, and (ii) wherein a first of the three openings is defined between the first and second refractory anchors, a second of the three openings is defined between the second and third refractory anchors, and a third of the three openings is defined between the third and first refractory anchors. In some such aspects, none of the three-opening cells has a mounting element within the three-opening cell. In some such aspects, the three-opening cells form a diagonal tessellated pattern, a zig-zag tessellated pattern, a parallelogram tessellated pattern, and/or a rhomboid tessellated pattern. In some such aspects, substantially half of the plurality of chevron cells are four-opening cells formed by an arrangement of four refractory anchors proximate one another. In some such aspects, (i) wherein a first of the four refractory anchors forms a first side proximate a tail of a chevron cell, a second of the four refractory anchors forms a second side of the chevron cell proximate the tail of the chevron cell, a third of the four refractory anchors forms a third two sides of the chevron cell, and a fourth of the four refractory anchors forms a fourth two sides of the chevron cell; and (ii) wherein a first of the four openings is defined between the first and second refractory anchors, a second of the four openings is defined between the second and third refractory anchors, a third of the four openings is defined between the third and fourth refractory anchors, and a fourth of the four openings is defined between the fourth and first refractory anchors.

In some such aspects, none of the four-opening cells has a mounting element within the four-opening cell. In some such aspects, the four-opening cells form a rectangular tessellated pattern.

In certain aspects, (i) substantially half of the plurality of chevron cells comprise two-opening cells formed by an arrangement of two refractory anchors proximate one another, and (ii) substantially half of the plurality of chevron cells comprise four-opening cells formed by an arrangement of four refractory anchors proximate one another.

According to aspects disclosed herein, an anchoring system for a refractory material for lining a thermal vessel includes a plurality of refractory anchors, the refractory anchors. Each refractory anchor comprises a mounting element positioned in the center of the refractory anchor that is adapted for mounting the refractory anchor to the thermal vessel; two three-anchor fin arrangements that are each directly connected to the mounting element by a first anchor fin positioned in each three-anchor fin arrangement, wherein each three-anchor fin arrangement is positioned on opposite sides of the mounting element relative to one another such that the first anchor fins of each three-anchor fin arrangement are angled ($\alpha$) relative to one another; and optionally a reinforcement fin connected to and extending away from one of the three-anchor fin arrangements. The refractory anchors are arranged in an ordered array of chevron cells in a tessellated pattern forming rows and columns, each chevron cell defines a longitudinal axis through its head and tail and a latitudinal axis through its first shoulder and its second shoulder, each column comprises a set of chevron cells having co-linear longitudinal axes, the columns are arranged side-by-side and parallel so that the longitudinal axes of each of the cells are in a parallel configuration, each row comprises a set of chevron cells having co-linear latitudinal axes, and the rows are arranged side-by-side and parallel so that the latitudinal axes of each of the cells are in a parallel configuration.

As disclosed herein, certain aspects of a method for installing the anchoring system disclosed herein on a thermal vessel includes (a) (optionally) providing a plurality of refractory anchors according to this disclosure; (b) arranging the refractory anchors in a tessellated pattern on the thermal vessel; (c) mounting the mounting elements of the refractory anchors to the thermal vessel; and (d) pouring refractory material into the tessellated pattern on the thermal vessel.

Embodiments of the invention can include one or more or any combination of the above features and configurations.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

Refractory Anchors

FIGS. 1A-5 depict the refractory anchor(s) (100) that are configured for increased and/or improved dispersion of the liner material during application and subsequent curing of the liner material while concurrently reducing the likelihood of micropocket formation (e.g., air micropocket formation) and/or macropocket formation (e.g., air macropocket formation) between the refractory anchor, liner, and thermal vessel interfaces thereby providing for increased thermal vessel liner lifespan and increased lifespan for thermal vessel use.

Figure 1A:
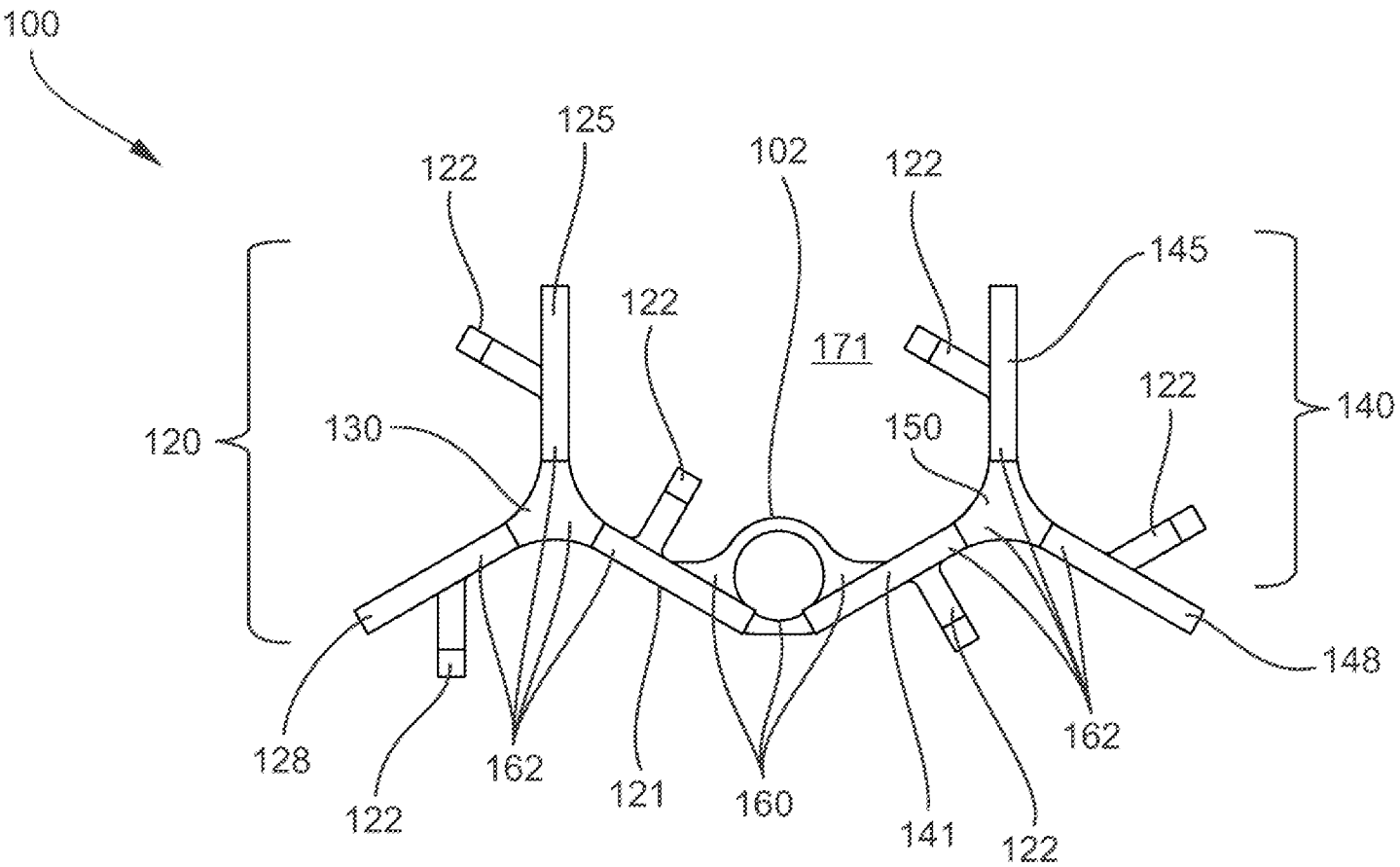
FIG. 1A is a top view of the refractory anchor depicting the mounting element and the two three-anchor fin arrangements.
Figure 1B:
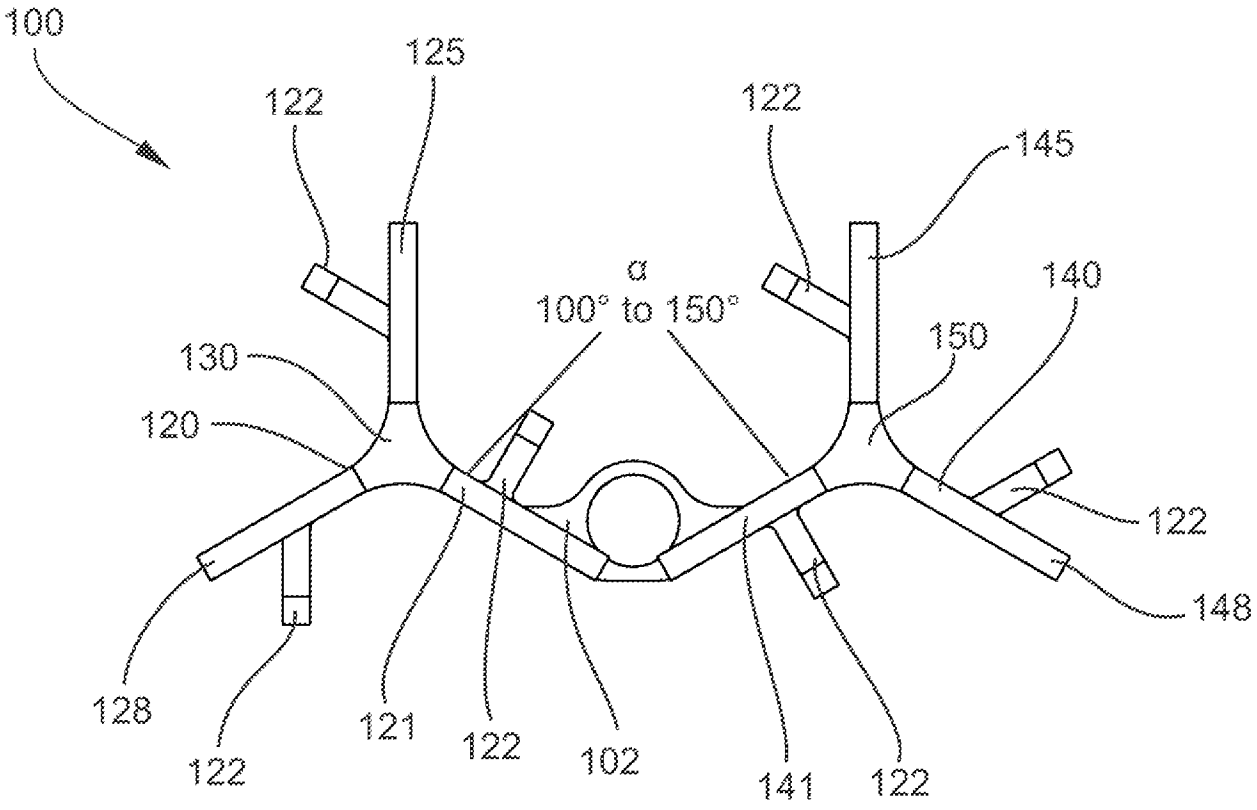
FIG. 1B is another top view of the refractory anchor depicting the first anchor fins in each anchor fin arrangement being angled relative to one another.

In particular, FIGS. 1A and 1B depict the refractory anchor (100) for lining a thermal vessel including (a) a mounting element (102) positioned in the center of the refractory anchor that is adapted for mounting the refractory anchor to the thermal vessel (not shown); (b) two three-anchor fin arrangements (120, 140) that are each directly connected to the mounting element (102) by a first anchor fin (121, 141) positioned in each three-anchor fin arrangement (120, 140), wherein each three-anchor fin arrangement is positioned on opposite sides of the mounting element (102) relative to one another such that the first anchor fins (121, 141) of each three-anchor fin arrangement (120, 140). As shown in FIG. 1B, the two three-anchor fin arrangements are not co-linear. Instead, the two three-anchor fin arrangements are angled relative to one another, and more particularly, that the first anchor fins (121, 141) in each three-anchor fin arrangement (120, 140) are angled ($\alpha$) at an angle ranging from 100° to 150°, more preferably from 105° to 130°, and even more preferably from 115° to 125° to one another. The above-mentioned angles, as well as the below mentioned external grooves and external voids (179 in FIG. 2C) synergistically interact with one another to facilitate and improve liner material application, dispersion, and subsequent curing, which reduces the likelihood of premature cracking and/or biscuiting of the thermal vessel liner. In addition and as further discussed below, the refractory anchor (100) may optionally further include a reinforcement fin (122) connected to and extending away from one of the three-anchor fin arrangements, which may also function to strengthen the thermal liner when the anchors are in use.

As shown in FIGS. 1A and 1B, each three-anchor fin arrangement (120, 140) includes a center portion (130, 150) connected to the first anchor fin (121, 141), a second anchor fin (125, 145), and a third anchor fin (128, 148). The first anchor fin (121, 141), the second anchor fin (125, 145), and the third anchor fin (128, 148) of each three-anchor fin arrangement (120), 140) radially extend away from the center portion (130, 150) in its respective three-anchor fin arrangement. Moreover, the first anchor fin (121, 141) in each three-anchor fin arrangement (120, 140) is positioned between and directly connected to the mounting element (102) and the center portion (130, 150) of the respective three-anchor fin arrangement (130, 150).

Figure 2A:
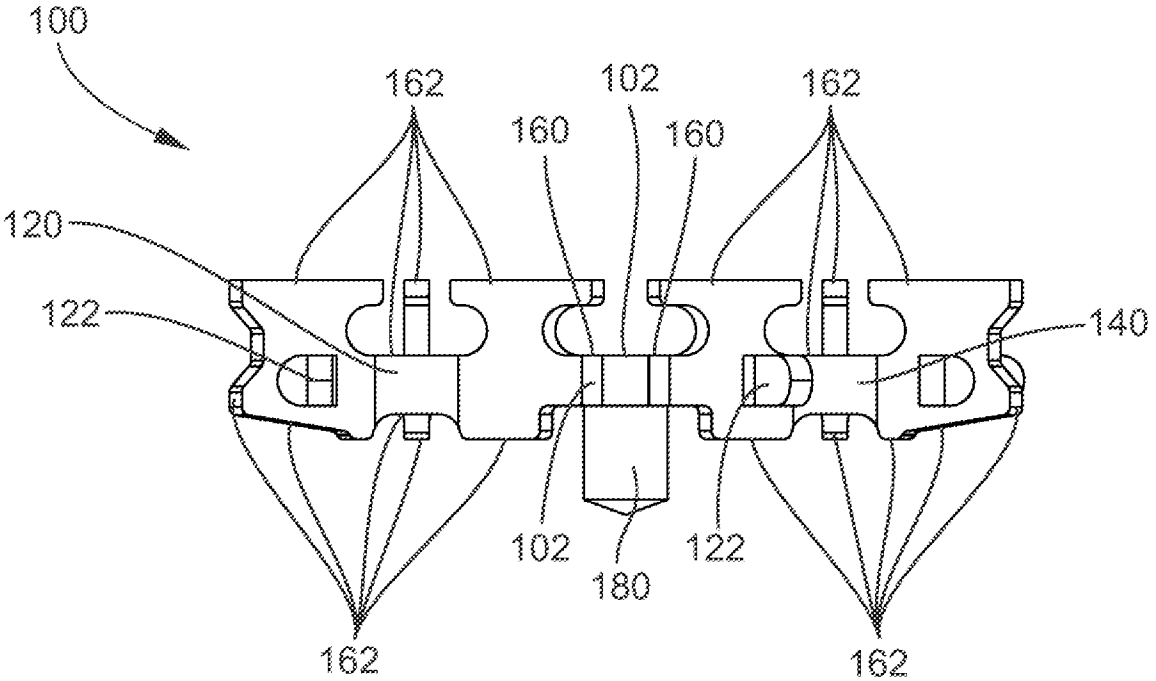
FIG. 2A is a front view of the refractory anchor depicting the outermost peripheral edges of the mounting element and two three-anchor fin arrangements.
Figure 2B:
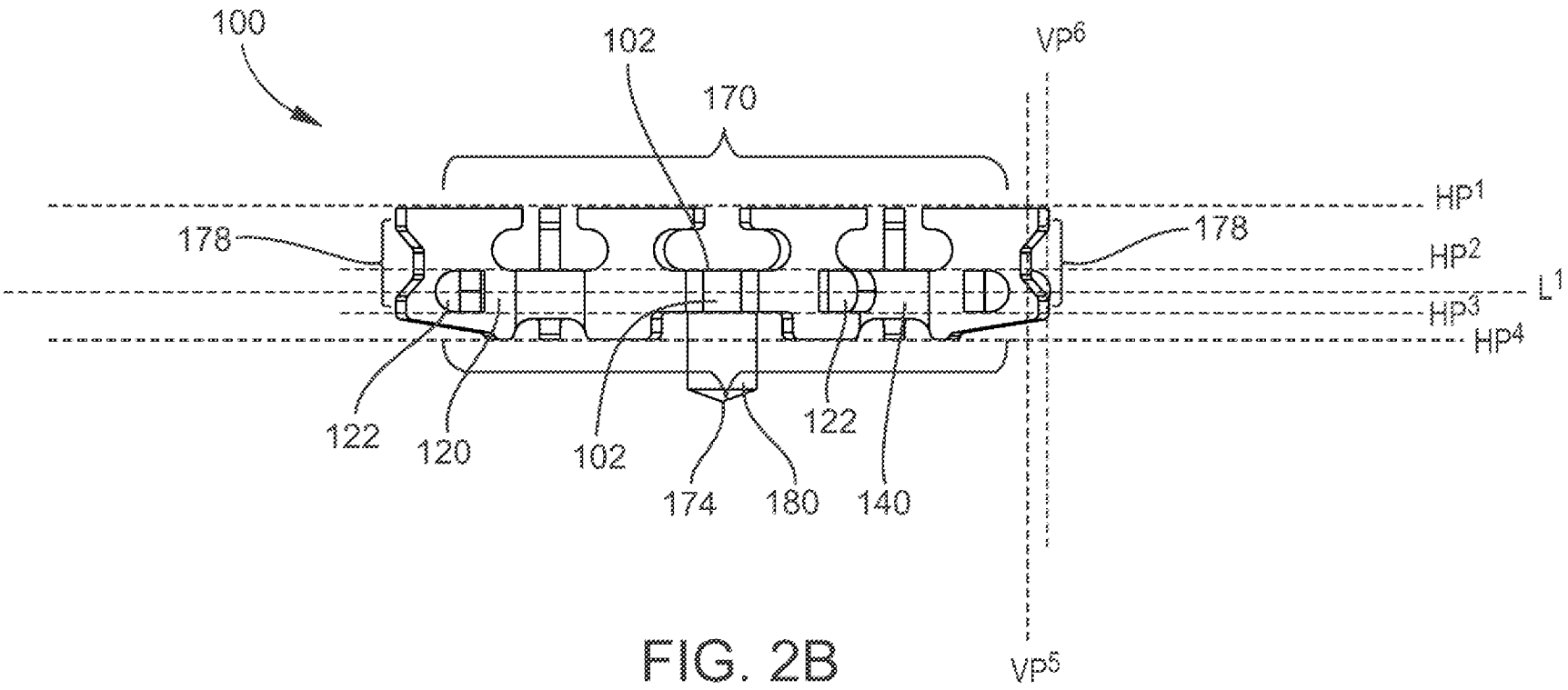
FIG. 2B is the front view of FIG. 2A further depicting the upper and lower surfaces of the refractory anchor as well as the outermost side surfaces of the second and third anchor fins in each three-anchor arrangement.
Figure 2C:
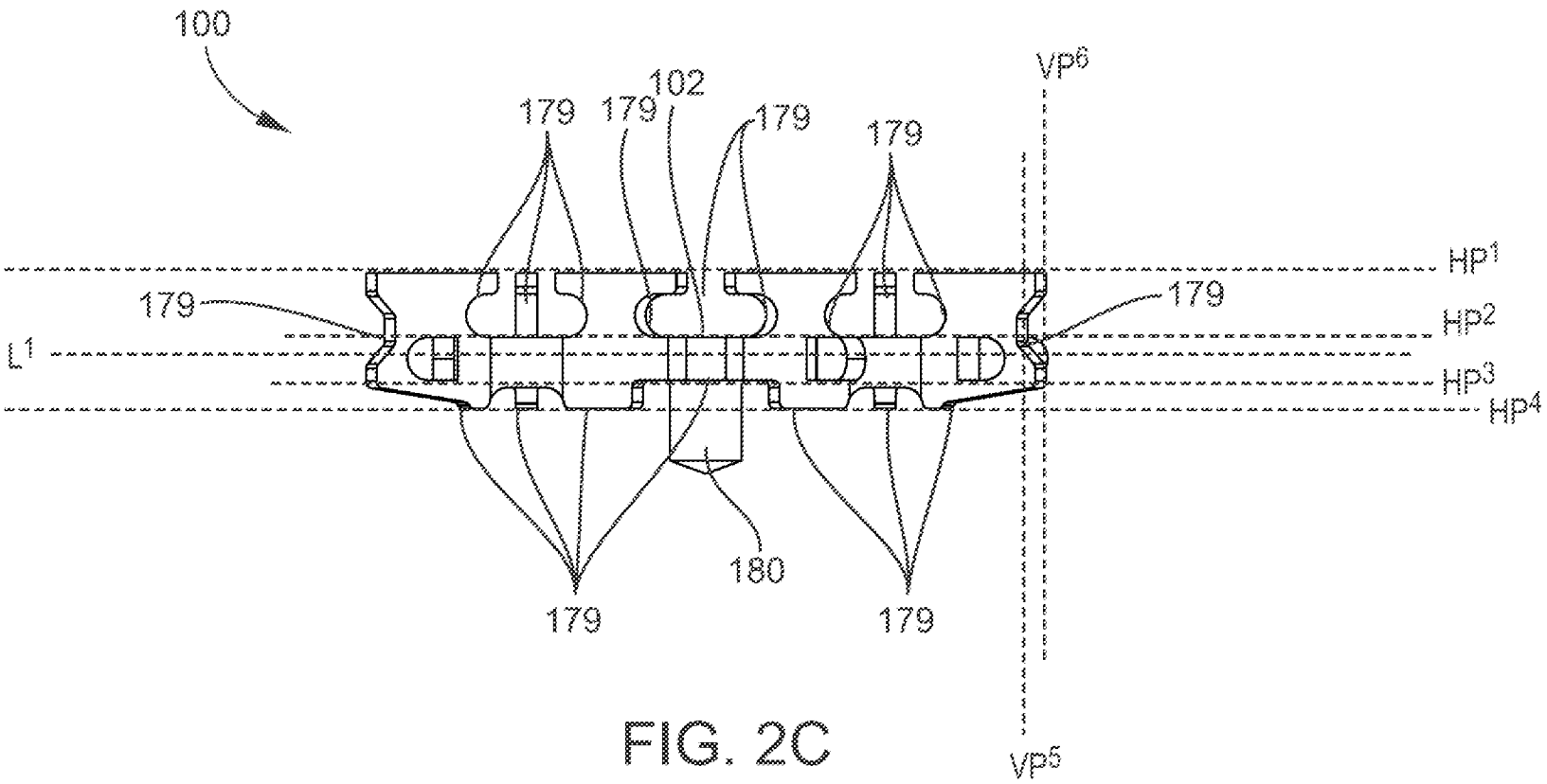
FIG. 2C is the front view of FIGS. 2A and 2B further depicting the external grooves and external voices defined by the outermost peripheral edges of the mounting element and two three-anchor fin arrangements.
Figure 3:
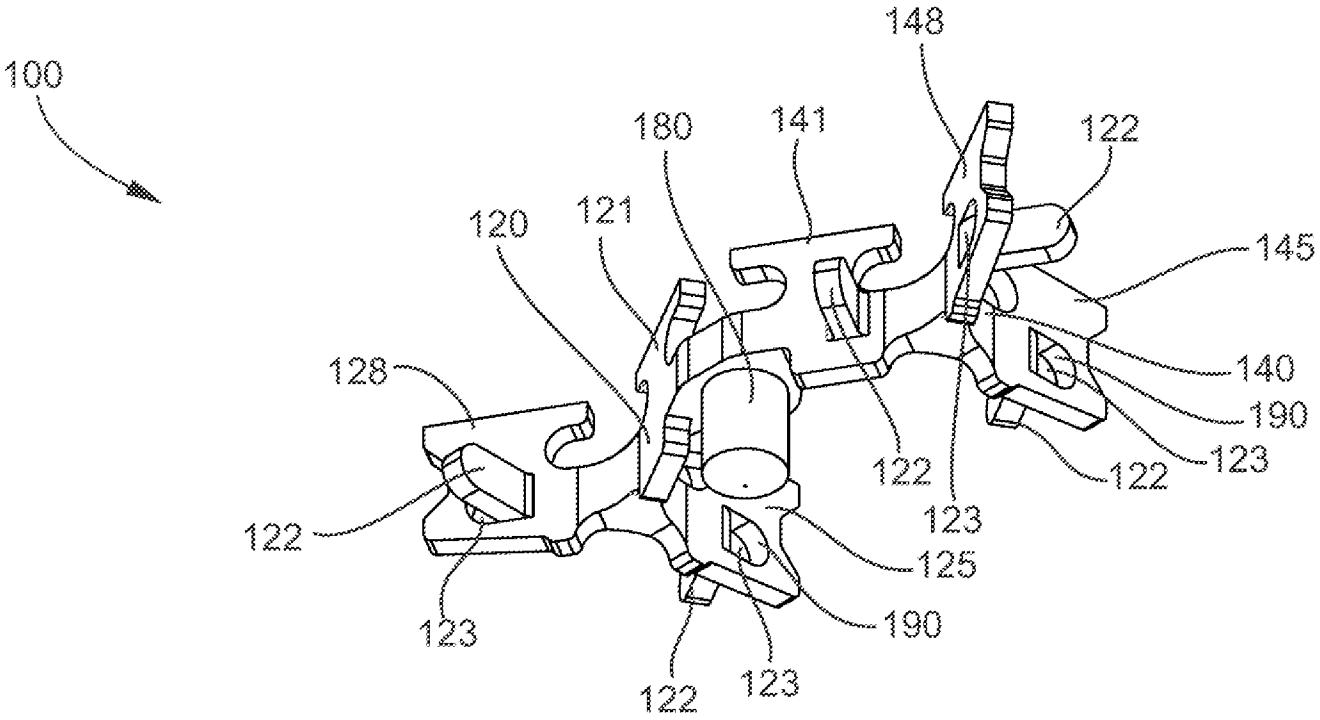
FIG. 3 is a bottom perspective view of the refractory anchor.
Figure 4:
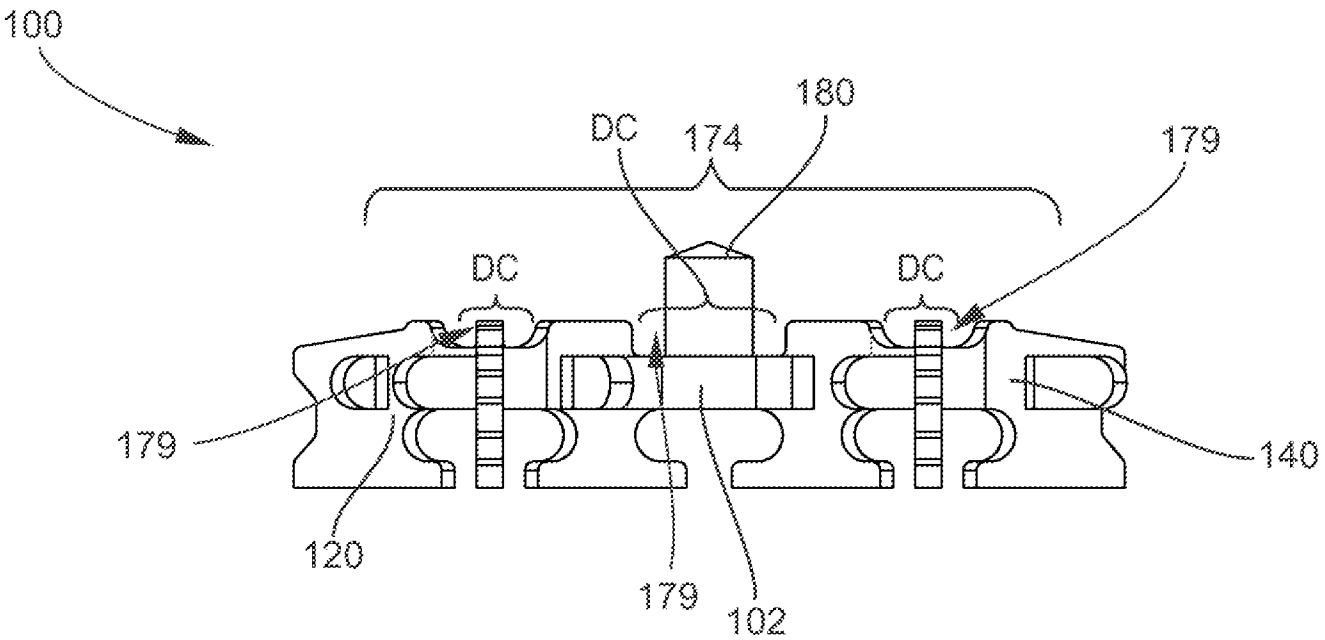
FIG. 4 is an inverted back view of the refractory anchor.
Figure 5:
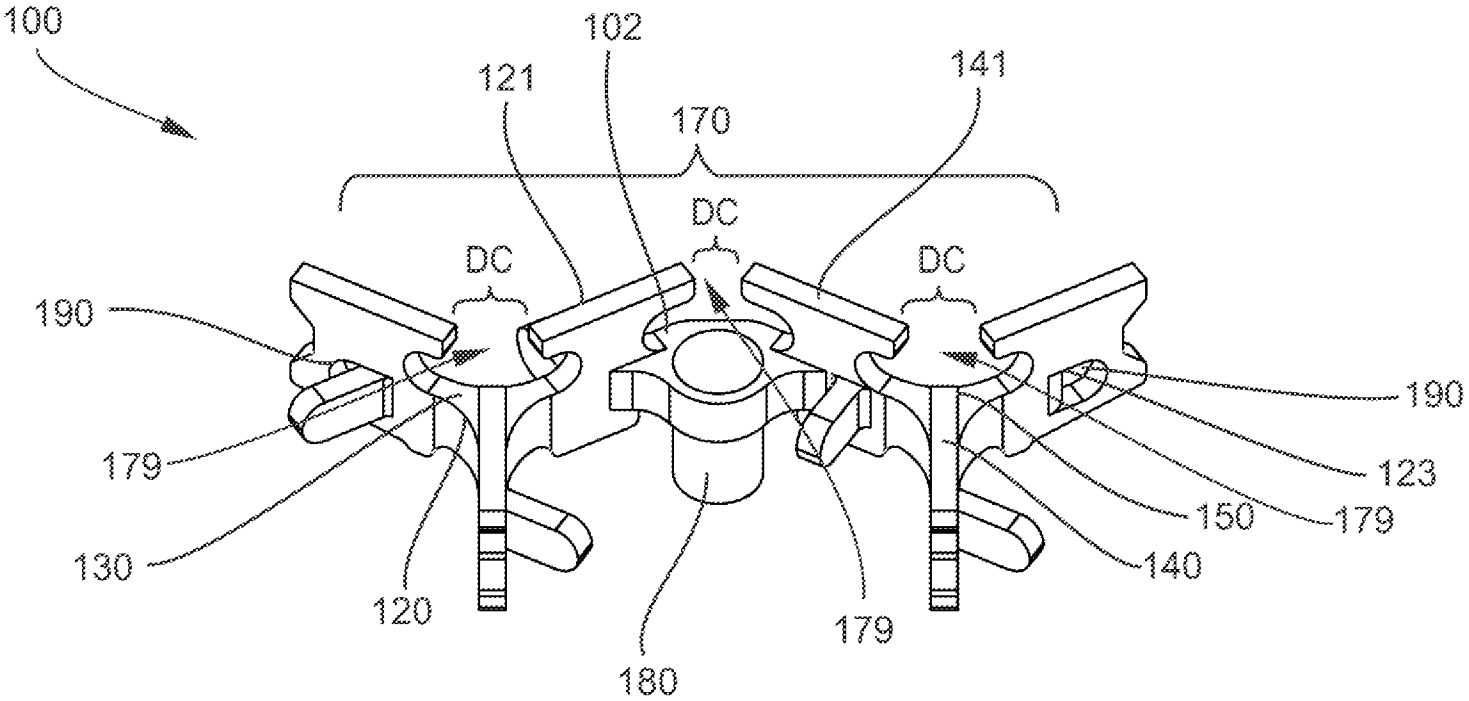
FIG. 5 is back, overhead perspective view of the refractory anchor.

FIGS. 2A-2C each depict the same front view of the refractory anchor (100), but each figure includes different structural features labelled therein. With specific reference to FIGS. 2A-2C, the refractory anchors (100) disclosed therein include outermost peripheral edges that define the upper surface (170) of the anchor, lower surface (174) of the anchor, and outermost side surfaces of various anchor fins in each three-anchor fin arrangement. In particular and as shown in FIGS. 2A and 2B, the outermost peripheral edges (160 in FIG. 2A) of the mounting element (102) and outermost peripheral edges (162 FIG. in 2A) of the two three-anchor fin arrangements (120, 140) define an upper surface (170 in FIG. 2B) and lower surface (174 in FIG. 2B) of the refractory anchor as well as outermost side surfaces (178 in FIG. 2B) of the second anchor fin (125, 145) and the third anchor fin (128, 148) in each three-anchor fin arrangement (120, 140).

As further shown in FIGS. 2A-2C, the outermost peripheral edges (160) of the mounting element (102) and/or the outermost peripheral edges (162 in FIG. 2A) of the two three-anchor fin arrangements (120, 140) define external grooves and/or external voids (collectively 179 in FIG. 2C) in at least one of: the upper surface (170 in FIG. 2B) of the refractory anchor, the lower surface (174 in FIG. 2B) of the refractory anchor, and/or the outermost side surfaces (178 in FIG. 2B) of the second anchor fin (125, 145) and/or the third anchor fin (128, 148) in each three-anchor fin arrangement. As further shown in FIGS. 2A-2C, in certain preferred aspects, the external grooves and/or external voids (collectively 179 in FIG. 2C) are present that are defined by the outermost peripheral edges of the mounting element (102) and/or the outermost peripheral edges of the two three-anchor fin arrangements (120, 140) are configured to facilitate flow and dispersion of liner material during application of the liner material in the thermal vessel while the refractory anchor is in use.

With specific reference to FIGS. 2B and 2C, the different planes disclosed herein are described in an orientation relative to the longitudinal axis ($L^1$) of the refractory anchor (100) when the anchor is viewed from the front or back. "HP" refers to horizontal planes, which are substantially parallel to the longitudinal axis ($L^1$) of the refractory anchor (100) when the anchor is viewed from the front or back, and "VP" refers to vertical planes, which are substantially transvers or perpendicular to the longitudinal axis ($L^1$) of the refractory anchor (100)) when the anchor is viewed from the front or back.

As specifically shown in FIGS. 2B and 2C, the external grooves and/or external voids (collectively 179 FIG. 2C) are present in the upper surface (170) of the refractory anchor device such that portions of the upper surface of the of the refractory anchor device are present in different planes ($HP^1$ (horizontal plane 1) and $HP^2$ (horizontal plane 2) in FIGS. 2B and 2C) and are configured to facilitate flow and dispersion of liner material (over and around the anchor) during application of the liner material in the thermal vessel while the refractory anchor is in use. Alternatively stated and as further shown in FIG. 5, the uppermost surface of each fin in the upper surface (170) of the refractory anchor (100) is discontinuous (DC) relative to one another due to the external grooves and/or external voids (179) formed in each respective center portion (130, 150) of each three-anchor fin arrangement relative to the uppermost surface of each fin as well as the external grooves and/or external voids (179) formed in the mounting element (102) relative to the uppermost surface of each fin. Improved abrasion resistance of the thermal vessel liner is achieved due to the unique structural features of the refractory anchor's upper surface disclosed immediately above and depicted in FIGS. 2A-2C and FIG. 5. In particular, the improved abrasion resistance is achieved because portions of the upper surface (170) of the refractory anchor reside in different planes ($HP^1$ and $HP^2$ respectively in FIGS. 2B and 2C). When the liner material is applied and subsequently cured, the overall exposed surface area of the upper surface of the disclosed anchor is greatly reduced when compared to conventional refractory anchors because the entire upper surface of the disclosed refractory anchor does not reside in the same or substantially the same plane.

By reducing the overall exposed surface area of the upper surface of the anchors disclosed herein, the total upper surface of the anchor exposed to an abrasive environment while the thermal vessel is in use is greatly reduced, which advantageously leads to reduced corrosion of the refractory anchor, reduced disassociation of the refractory anchor from the liner associated with refractory anchor corrosion, and an increase in liner lifespan as well as increased use of the thermal vessel.

Likewise, the lower surface (174) of the anchor (100) has a unique configuration that further aids in liner material dispersion. In particular, FIGS. 2B and 2C depict external grooves and/or external voids (collectively 179 FIG. 2C) are present in the lower surface (174) of the refractory anchor device such that portions of the lower surface of the of the refractory anchor device are present in different planes ($HP^3$ (horizontal plane 3) and $HP^4$ (horizontal plane 4) in FIGS. 2B and 2C) that are configured to facilitate flow and dispersion of liner material (e.g., between the thermal vessel wall and the lower surface of the anchor immediately underneath the anchor) during application of the liner material in the thermal vessel while the refractory anchor is in use. Alternatively stated and as further shown in FIG. 4, the lowermost surface of each fin in the lower surface (174) of the refractory anchor (100) is discontinuous (DC) relative to one another due to the external grooves and/or external voids (179) formed in each respective center portion of each three-anchor fin arrangement relative to the lowermost surface of each fin as well as the external grooves and/or external voids (179) formed in the mounting element (102) relative to the lowermost surface of each fin.

In addition and as shown in FIGS. 2A-2C, the external grooves and/or external voids are present in the outermost side surfaces (179 in FIG. 2C) of the second anchor fin (125, 145) and/or the third anchor fin (128, 148) in each three-anchor fin arrangement such that portions of outermost side surfaces of the second anchor fin (125, 145) and/or the third anchor fin (128, 148) in each three-anchor fin arrangement of the refractory anchor device are present in different planes ($VP^5$ (vertical plane 5) and $VP^6$ (vertical plane 6) in FIGS. 2B and 2C) and are configured to facilitate flow and dispersion of liner material during application of the liner material in the thermal vessel while the refractory anchor is in use.

As shown in FIGS. 1A, 1B, and FIGS. 3-5, the refractory anchors (100) may further include reinforcement segments (122) positioned on the refractory anchor. The reinforcement segments function to increase surface area of the anchor thereby further strengthening and increasing lifespan of the cured liner. In certain aspects, one to six reinforcement segments (122) are positioned in the refractory anchor device in between the upper (170) and lower (174) surfaces of the refractory anchor device, and in preferred aspects, one to four reinforcement segments (122) are positioned in the refractory anchor device in between the upper (170) and lower (174) surfaces of the refractory anchor device. As shown in FIGS. 1A, 1B, and 3-5 and when present, each reinforcement segment (122) is directly connected to and extends away from one of the two three-anchor fin arrangements (120, 140). In certain preferred aspects, each reinforcement segment (122) is positioned on a different fin of the two three-anchor fin arrangements (120, 140). Each reinforcement segment (122) may be shorter than the fins in each three fin arrangement (120, 140), which further aids in arranging the refractory anchors (100) in an unencumbered pattern in which each refractory anchor is spaced apart and does not contact another refractory anchor thereby maximizing the surface area that each refractory anchor convers when arranged in a desired pattern while further minimizing the number of anchors used in each pattern.

In certain aspects and to better improve dispersion of the liner material by passing the liner material internally through portions of the anchor to more homogeneously disperse the liner material in and around the anchor, internal openings (123) are formed in the anchor fins of the three-anchor fin arrangements (120, 140) between and spaced apart from the upper surface (170), the lower surface (174) and outermost side surfaces of the anchor fins. The internal openings (123) are formed within and defined by internal peripheral edges (190) of the anchor fins (e.g., second anchor fin (125, 145) and/or the third fin (128, 148)) of the two three-anchor fin arrangements (120, 140). In certain aspects and when the internal openings (123) and reinforcement segments (122) are both present, the internal opening (123 in FIG. 3) is immediately adjacent to the at least one reinforcement segment is configured to further facilitate flow and dispersion of liner material during application of the liner material in the thermal vessel while the refractory anchor is in use.

As further shown in FIGS. 1A and 1B, the refractory anchor (100) includes a semi-hexagonal shape (170) formed by a combination of the first anchor fin (121) and another anchor fin in the first three-anchor fin arrangement (120) and by the first anchor fin (141) and another anchor fin in the second three-anchor fin arrangement (140). Unlike many conventional refractory anchors, the disclosed refractory anchor (100) includes only one semi-hexagonal shape (170) formed by the two three-anchor fin arrangements, which further allows the anchors disclosed herein to be arranged in a diverse number of patterns including both hexagonal patterns and non-hexagonal patterns that can be adapted as desired in view of the areas to which the anchors are being mounted.

In additional aspects and as further shown in FIGS. 1A-5, the refractory anchor (100) includes a mounting pin (180) connected to the mounting element (102) in which the mounting pin is configured for directly mounting the anchor onto a desired surface. In certain aspects, the refractory anchor (100) (further including the mounting pin) may be monobloc (i.e., a unitary, cast anchor) in which no clinching mechanisms to fasten multiple parts together are necessary. However, in alternative aspects, the refractory anchor (100) and mounting pin (180) may be separate elements requiring further assembly by, for example, refractory welding the two components together using a ferrule, ferrule holder, and welding gun and/or equipped for another form of engagement such as a friction fit or threaded engagement.

As should be apparent from the above disclosures, the above disclosed refractory anchors (100) are easier to install than conventional refractory anchors, thus resulting in reduced installation times. Moreover, due to the unique structural features of the disclosed anchors, thermal vessel use and lifespan are advantageously increased due to the increased and/or improved dispersion of the liner material during application and subsequent curing of the liner material, which advantageously reduces the likelihood of micropocket formation (e.g., air micropocket formation) and/or macropocket formation (e.g., air macropocket formation) between the refractory anchor, liner, and thermal vessel interfaces. Moreover, improved abrasion resistance is achieved because portions of the upper surface of the refractory anchor reside in different planes (i.e., certain portions of the refractory anchor's upper surface are recessed relative to other portions of the upper surface), which advantageously leads to reduced corrosion of the refractory anchor, reduced disassociation of the refractory anchor from the liner associated with refractory anchor corrosion, and an increase in liner lifespan as well as increased use of the thermal vessel.

Predetermined Patterns/Arrays

Referring to FIGS. 6A-6H (collectively referred to herein as "FIG. 6"), an anchoring system (602) is illustrated. The anchoring system (602) is configured for anchoring a refractory material for lining a thermal vessel. The anchoring system (602) includes a plurality of refractory anchors (100) such as those discussed in detail above. The refractory anchors (100), as discussed above, include a mounting element (102), two three-anchor fin arrangements (120, 140) that are each directly connected to the mounting element (102) as discussed above, such as by one of three anchor fins (121, 141). The refractory anchors (100) may optionally include one or more reinforcement fins (122) also discussed above.

As shown in FIG. 6, the refractory anchors (100) of the anchoring system (602) are arranged in an ordered array of hexagonal cells (604), hexagonal-shaped cells, or substantially hexagonal cells in a tessellated pattern (600). The tessellated pattern (600) forms rows (606) and columns (608) of hexagonal cells (604). In other words, each hexagonal cell (604) of the tessellated pattern (600) is part of a row (606) and is also part of a column (608).

Figure 6A:
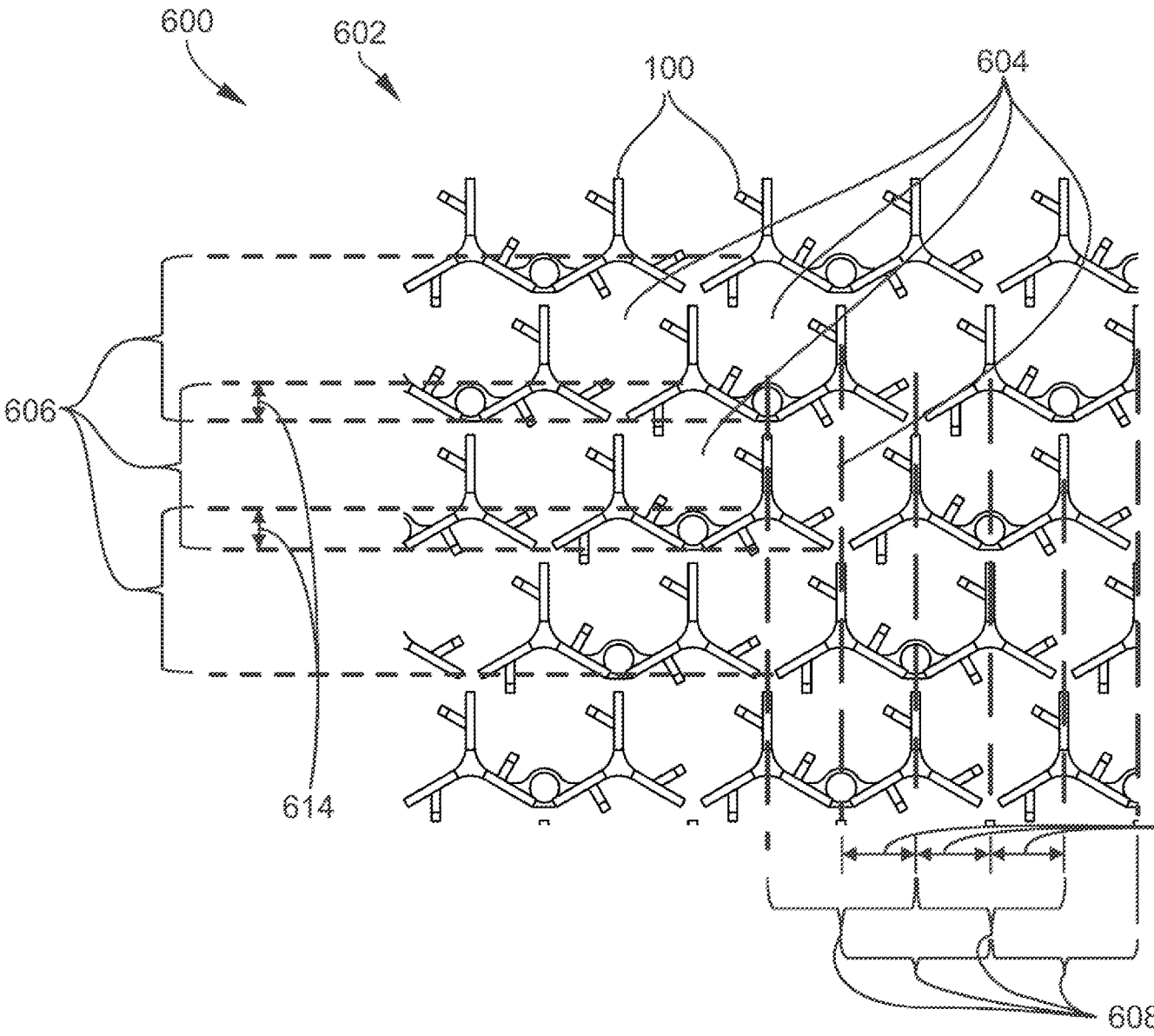
FIGS. 6A, 6B, 6C, 6D, 6E, 6F, 6G, and 6H are each overhead views of a hexagonal tessellated pattern of refractory anchors.
Figure 6B:
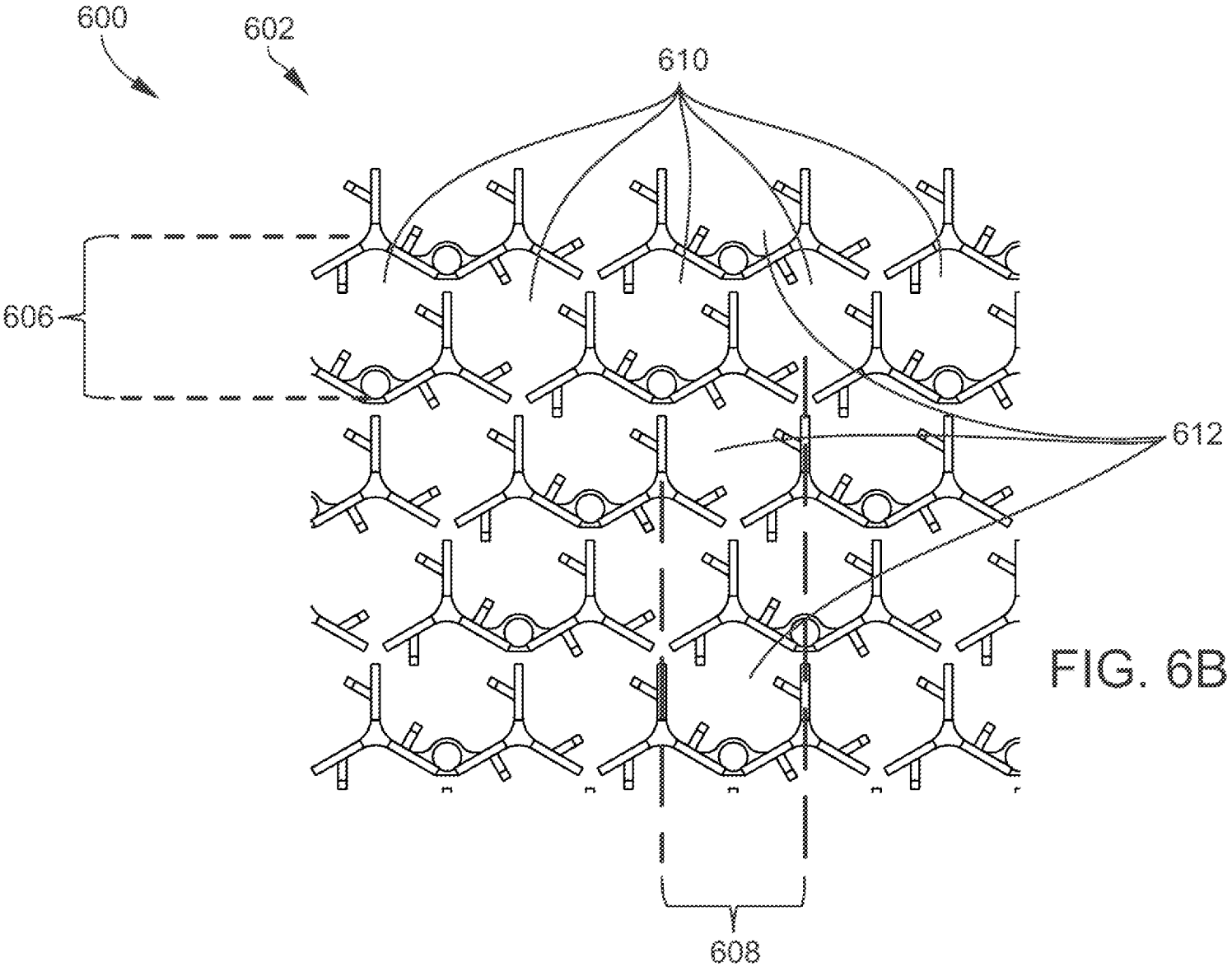

As shown in FIG. 6B, each column (608) includes a set (612) of the hexagonal cells (604), and each row (606) includes a set (610) of the hexagonal cells (604). The set (612) of hexagonal cells (604) of a column (608) are aligned or co-linear (or substantially co-linear) and are spaced apart from one another, or in other words are non-adjacent to one another. Each column (608) is made up of a hexagonal cell (604) from every-other row (606) of the tessellated pattern (600). Each row (606) includes a set (610) of the hexagonal cells (604). The set (610) of hexagonal cells (604) of a row (606) are aligned or co-linear (or substantially co-linear) and are arranged adjacent (or substantially adjacent) to one another. The tessellated pattern (600), which forms a plurality of hexagonal cells (604), is at least partially a honeycomb pattern in certain embodiments.

Referring specifically to FIG. 6A, the rows (606) of the tessellated pattern (600) overlap one another. The overlap involves upper corners of hexagonal cells (604) in a lower row overlapping the lower corners of hexagonal cells (604) in a higher row, where the lower and higher row are adjacent. The distance of overlap is shown in FIG. 6A by callout (614). Similarly, the columns (608) of the tessellated pattern (600) also overlap one another. The overlap involves side corners of the hexagonal cells (604) of adjacent columns (608) overlapping one another. The distance of overlap is shown in FIG. 6A by callout (616).

Figure 6C:
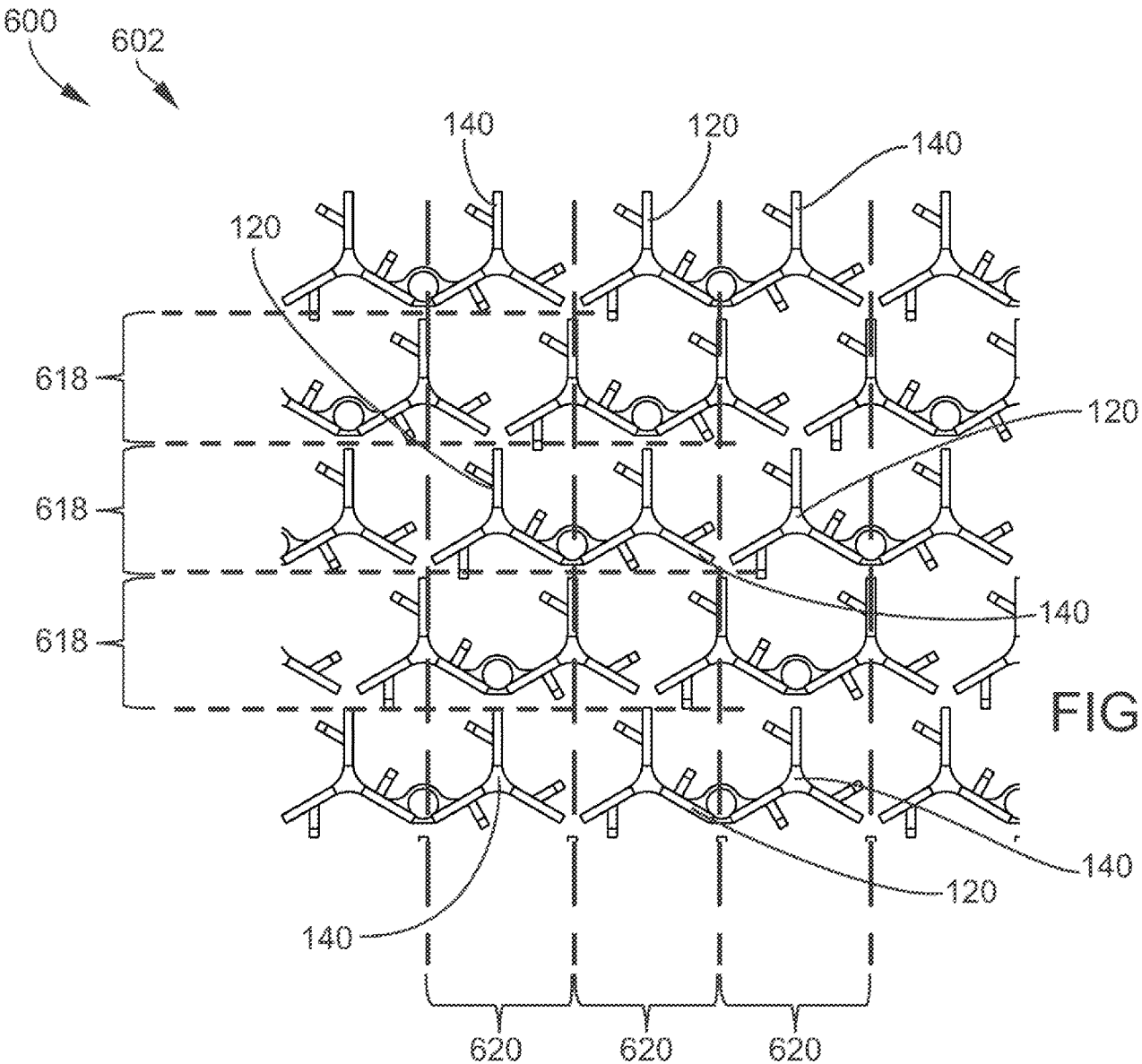

Referring to FIG. 6C, each of the three-anchor fin arrangements (120, 140) of each of the refractory anchors (100) is arranged in a tessellated pattern forming three-anchor fin arrangement rows (618) and three-anchor fin arrangement columns (620). The rows (618) are formed of a set of co-linear or aligned (or substantially co-linear) arrangements (120, 140). The three-anchor fin arrangement rows (618) are formed by a pattern of alternating three-anchor fin arrangement (120) with three-anchor fin arrangement (140) and then another three-anchor fin arrangement (120) followed by another three-anchor fin arrangement (140) and so on. The row (618) is formed by refractory anchors (100) arranged side-by-side or adjacent to one another, and the order of arrangements (i.e., 120, 140, 120, 140, etc.) follows.

A three-anchor fin arrangement columns (620) is formed by a pattern of repeating arrangement (120), or in a different column (620), a pattern of repeating arrangement (140) forms the column (620). In other words, a single column (620) is made up only of arrangements (120) and does not include any arrangements (140). The adjacent columns (620) are both made up solely of arrangements (140). The columns (620) are formed of a set of co-linear or aligned (or substantially co-linear) arrangements (120, 140). Notably unlike the set of arrangements forming rows (618), the arrangements (120, 140) forming the columns (620) are spaced-apart or non-adjacent from one another, because they are separated by every other row (618).

Figure 6D:
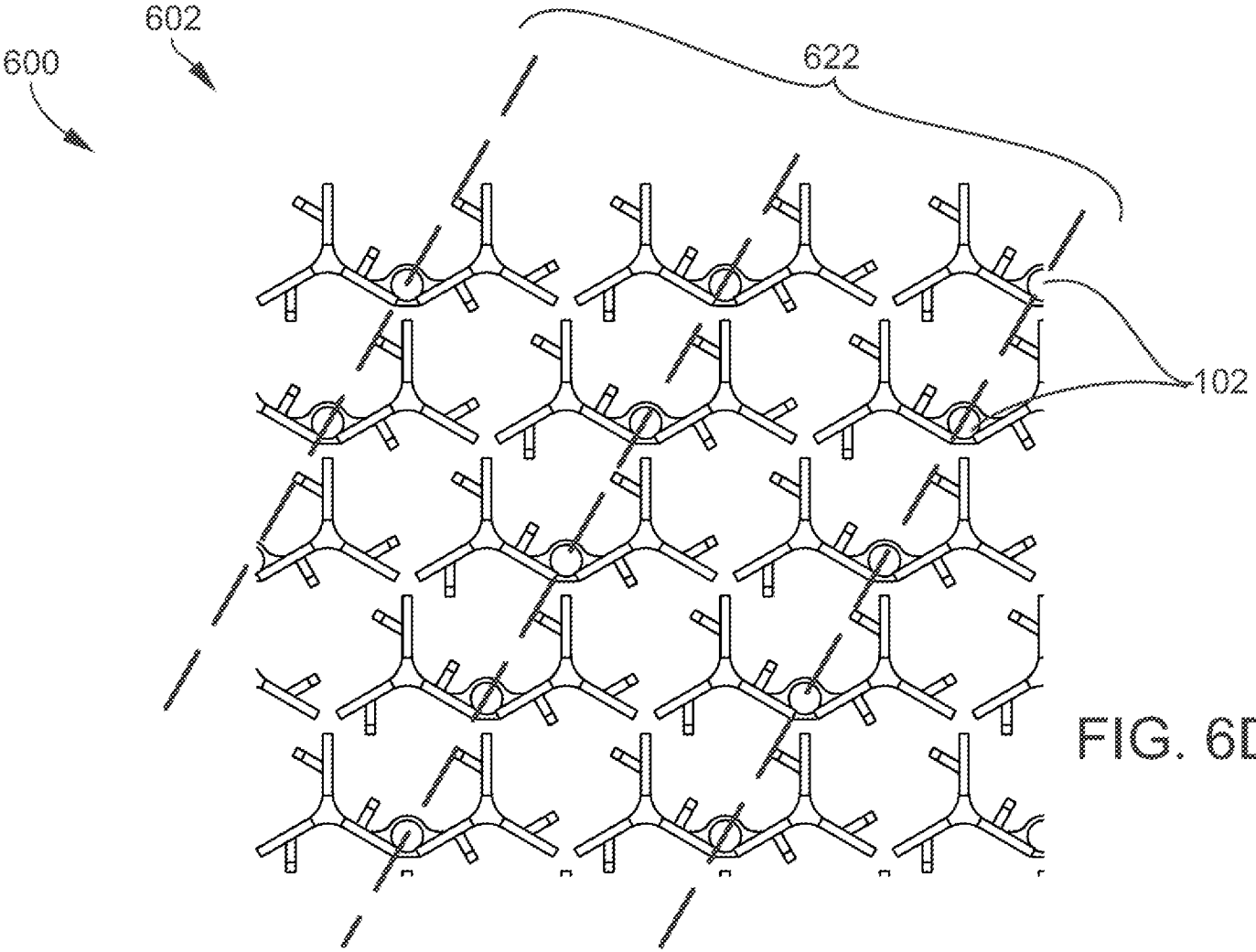

As shown in FIG. 6D, the mounting elements (102) of the refractory anchors (100) are arranged in a diagonal tessellated pattern (622) when the anchoring system (602) is arranged in tessellated pattern (600). Similarly, the tessellated pattern may be characterized based on the hexagonal cells (604) themselves rather than the mounting elements (102). Namely, as shown in FIG. 6D, the tessellated pattern (600) of the refractory anchors (100) may be characterized in that the hexagonal cells (604) are arranged in a diagonal tessellated pattern (622). More specifically, the two-opening cells (632) are arranged in a diagonal tessellated pattern (622), and the three-opening cells (634) are likewise arranged in a diagonal tessellated pattern (622).

Figure 6E:
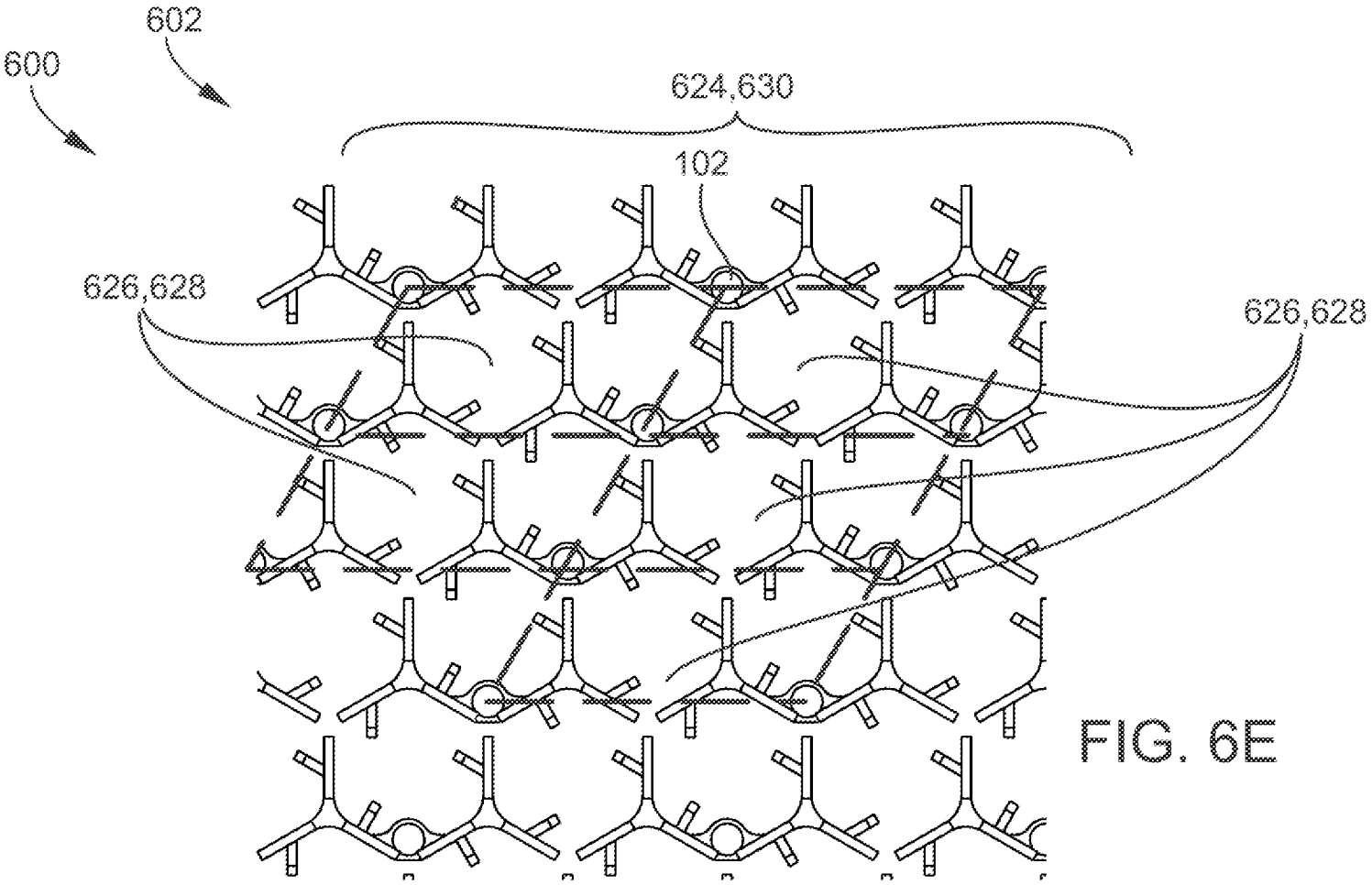

As shown in FIG. 6E, the mounting elements (102) of the refractory anchors (100) are also arranged in a parallelogram tessellated pattern (624) formed of a plurality of parallelograms (626) arranged adjacent to one another and in a similar orientation as shown. In some implementations of the tessellated pattern (600), the mounting elements (102) are arranged in a rhomboid tessellated pattern (630) formed by a plurality of rhomboids (628) arranged adjacent to one another and in a similar orientation as shown.

Figure 6F:
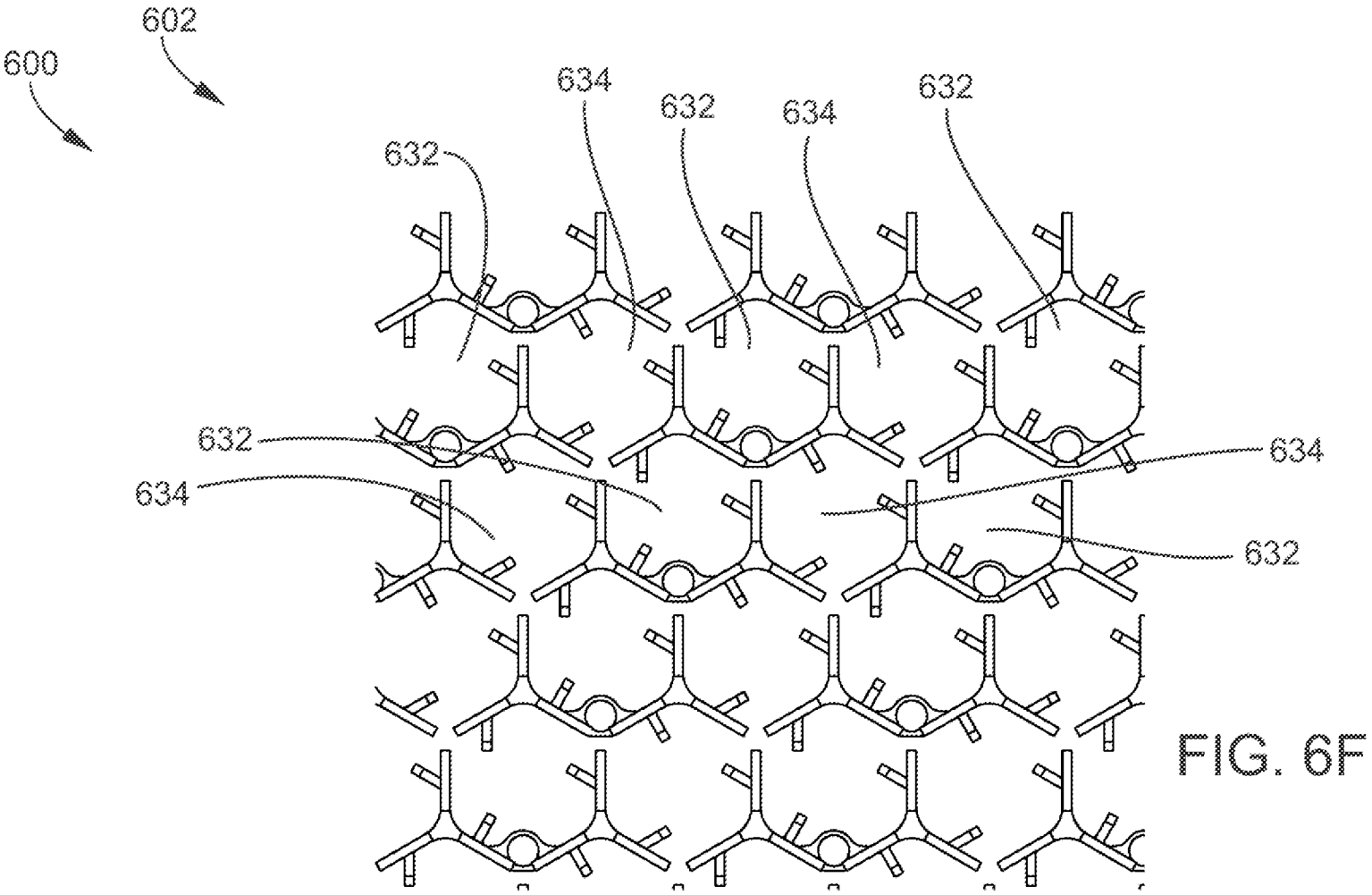

Referring now to FIG. 6F, half or substantially half of the plurality of hexagonal cells (604) of the tessellated pattern (600) is made up of two-opening cells (632). Likewise, half or substantially half of the plurality of hexagonal cells (604) of the tessellated pattern (600) is made up of three-opening cells (634). Each hexagonal cell such as the two-opening cells (632) and/or the three-opening cells (634) may have one, two, three or more fins (122) extending from the anchors (100) into the hexagonal cells (604).

Figure 6G:
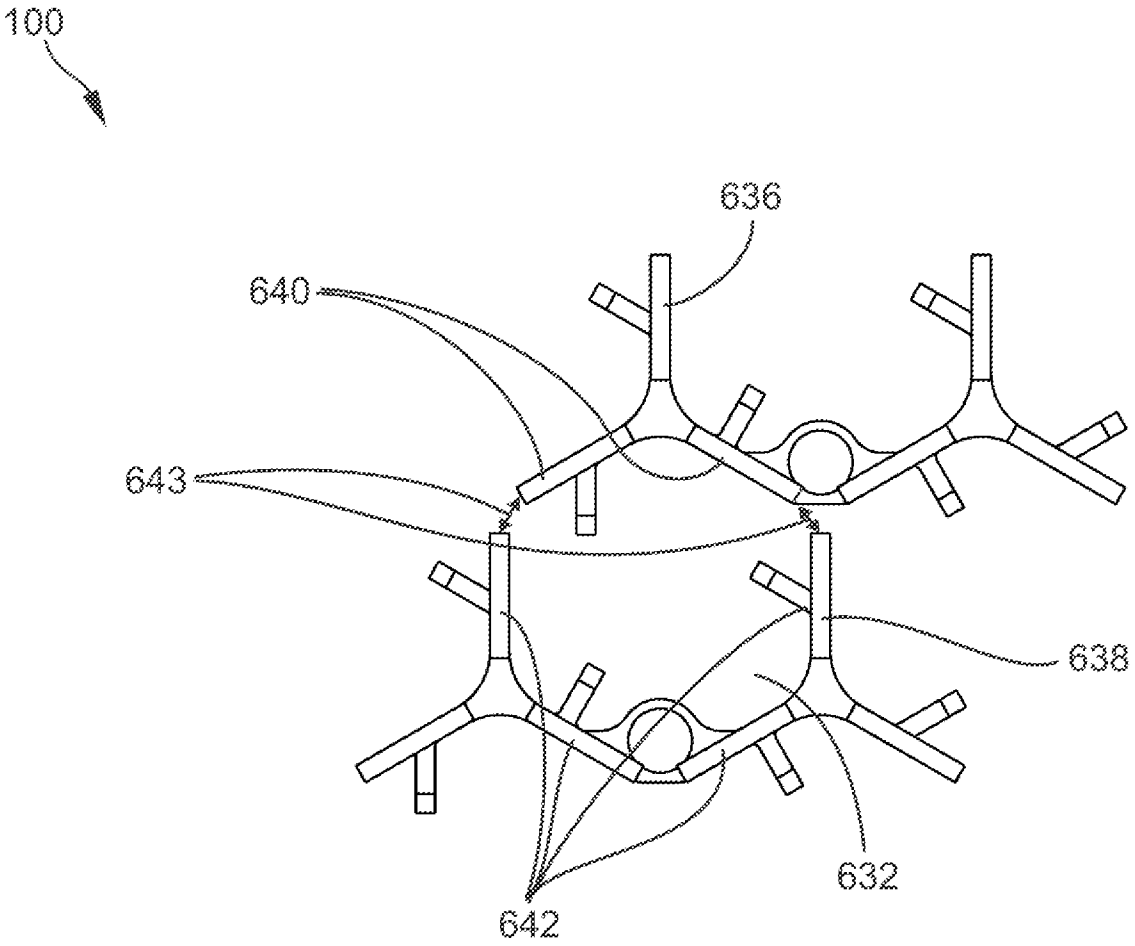

As shown in FIG. 6G, the two-opening cells (632) are formed by two refractory anchors proximate one another. A first refractory anchor (636) of the two anchors forms two sides (640) of a hexagonal cell (604). A second refractory anchor (638) of the two anchors forms four sides (642) of the two-opening cell (632). Two openings (643) are defined between the first refractory anchor (636) and the second refractory anchor (638). In certain embodiments of the two-opening cell (632) a mounting element (102) of the second of the two refractory anchors (638) is disposed within the two-opening cell (632). Typically it is connected near the center of the four sides (642) and extends into the space of the two-opening cell (632). In certain configurations, the two-opening cells (632) form a diagonal tessellated pattern (622) when the anchors (100) are arranged in tessellated pattern (600).

Figure 6H:
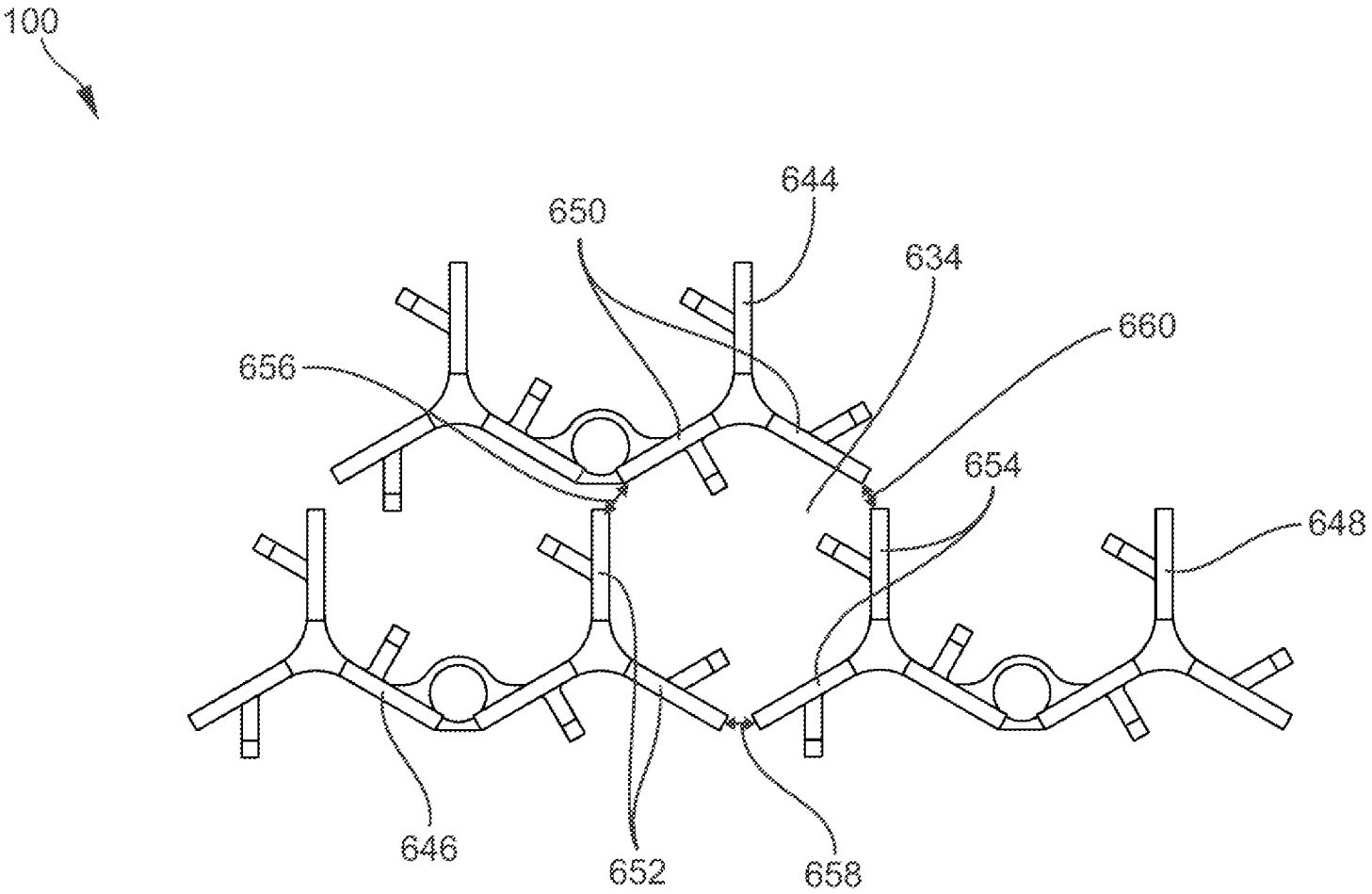

Referring to FIG. 6H, a three-opening cell (634) is formed of a first refractory anchor (644), a second refractory anchor (646), and a third refractory anchor (648) that are arranged proximate to one another. The first anchor (644) forms a first two sides (650) of the three-opening cell (634), the second anchor (646) forms a second two sides (652) of the three-opening cell (634), and the third anchor (648) forms a third two sides (654) of the three-opening cell (634). A first of three openings (656) is defined by the first anchor (644) and the second anchor (646), a second opening (658) is defined by the second anchor (646) and the third anchor (648), and a third opening (660) is defined by the third anchor (648) and the first anchor (644). As shown in FIG. 6H, the three-opening cell (634) does not have a mounting element inside it, or in other words, no mounting element is disposed such that it extends from any anchor into the interior space of the three-opening cell (634).

Referring now to FIGS. 7A-7H (collectively referred to herein as "FIG. 7"), an anchoring system (702) is illustrated. The anchoring system (702) is configured for anchoring a refractory material for lining a thermal vessel. The anchoring system (702) includes a plurality of refractory anchors (100) such as those discussed in detail above. The refractory anchors (100), as discussed above, include a mounting element (102), two three-anchor fin arrangements (120, 140) that are each directly connected to the mounting element (102) as discussed above, such as by one of three anchor fins (121, 141). The refractory anchors (100) may optionally include one or more reinforcement fins (122) also discussed above.

As shown in FIG. 7, the refractory anchors (100) of the anchoring system (702) are arranged in an ordered array of hexagonal cells (704), hexagonal-shaped cells, or substantially hexagonally-shaped cells in a tessellated pattern (700). The tessellated pattern (700) forms rows (706) and columns (708) of hexagonal cells (704). In other words, each hexagonal cell (704) of the tessellated pattern (700) is part of a row (706) and is also part of a column (708).

Figure 7A:
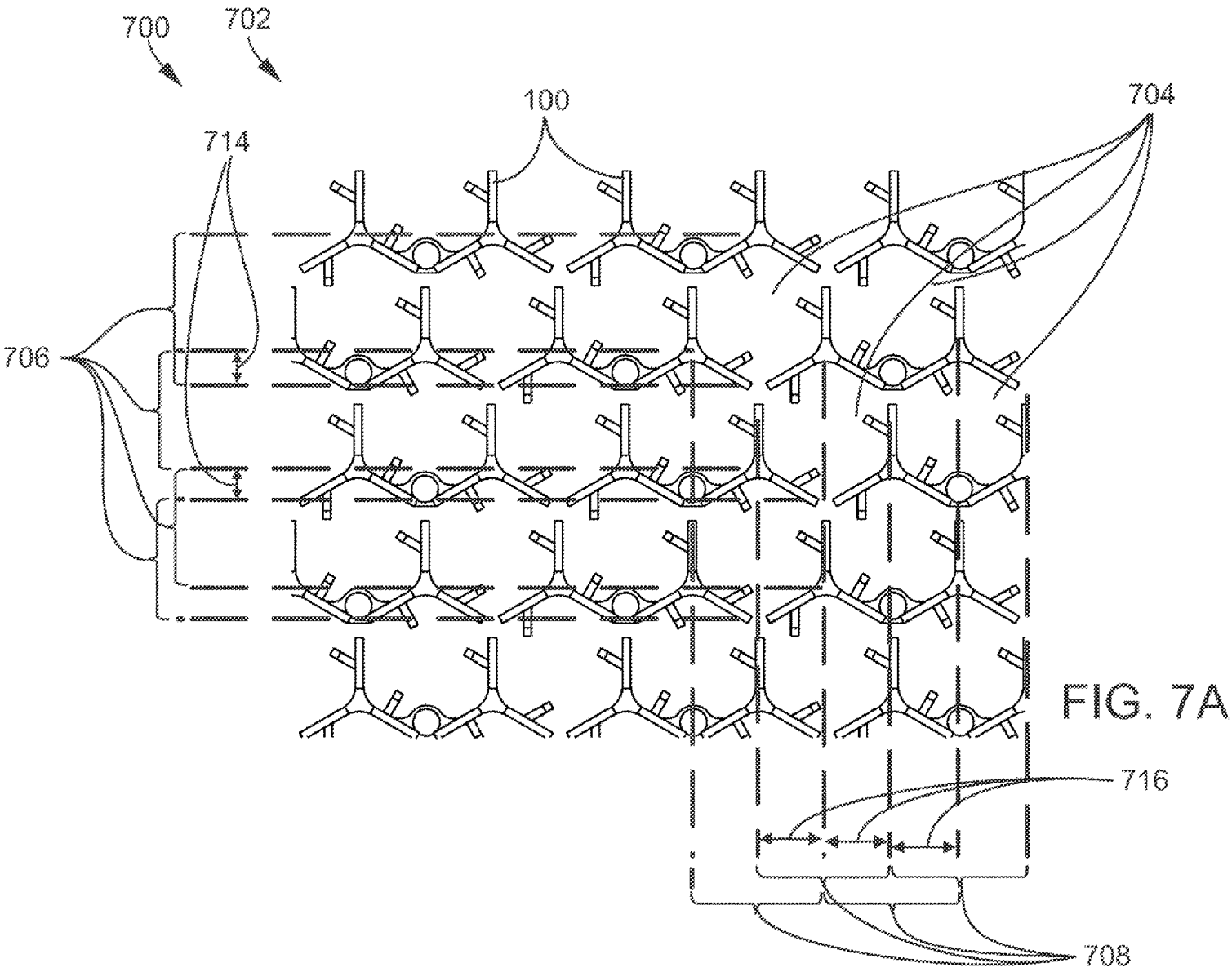
FIGS. 7A, 7B, 7C, 7D, 7E, 7F, 7G, and 7H are each overhead views of another hexagonal tessellated pattern of refractory anchors.
Figure 7B:
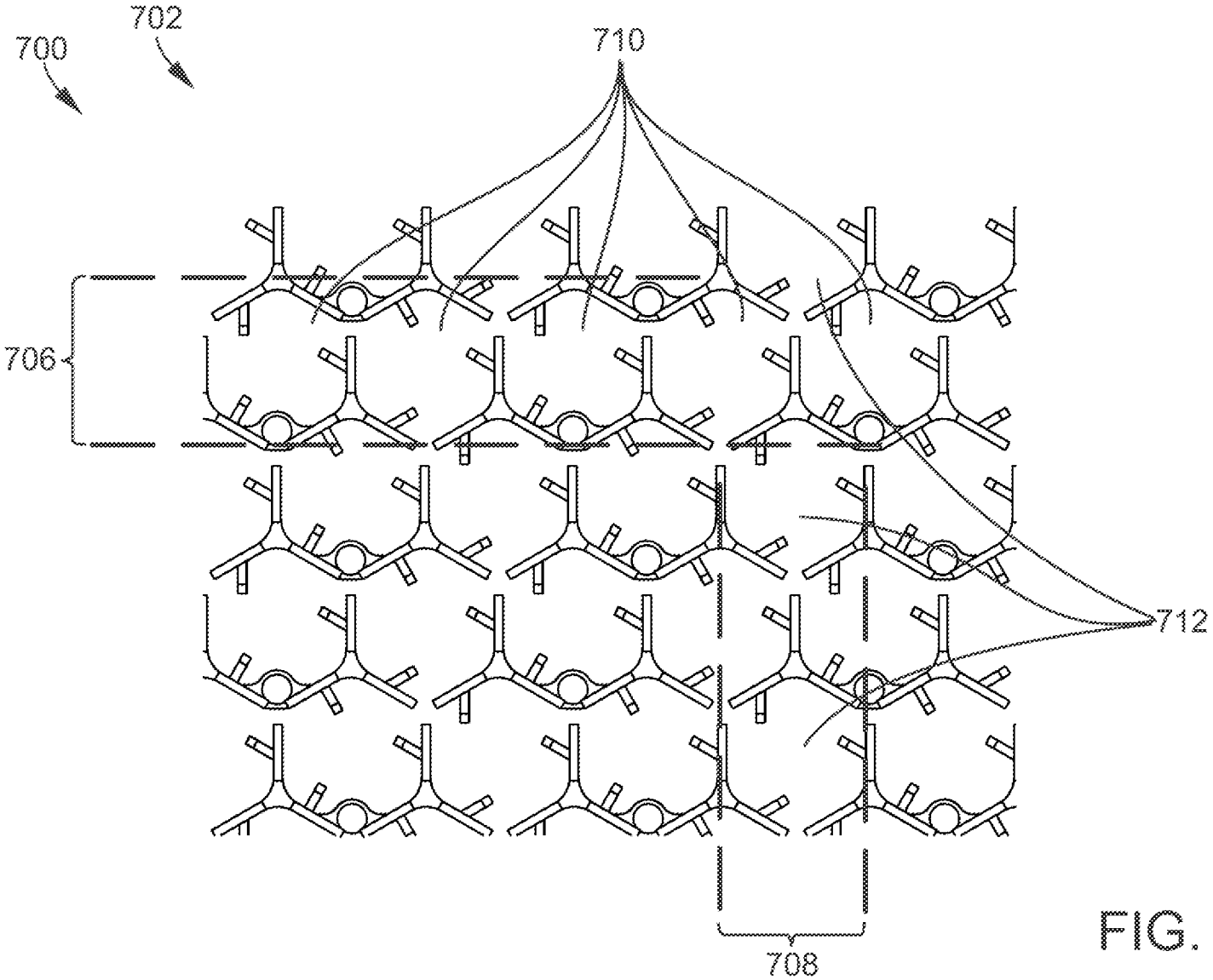

As shown in FIG. 7B, each column (708) includes a set (712) of the hexagonal cells (704), and each row (706) includes a set (710) of the hexagonal cells (704). The set (712) of hexagonal cells (704) of a column (708) are aligned or co-linear (or substantially co-linear) and are spaced apart from one another, or in other words are non-adjacent to one another. Each column (708) is made up of a hexagonal cell (704) from every-other row (706) of the tessellated pattern (700). Each row (706) includes a set (710) of the hexagonal cells (704). The set (710) of hexagonal cells (704) of a row (706) are aligned or co-linear (or substantially co-linear) and are arranged adjacent (or substantially adjacent) to one another. The tessellated pattern (700), which forms a plurality of hexagonal cells (704), is at least partially a honeycomb pattern in certain embodiments.

Referring specifically to FIG. 7A, the rows (706) of the tessellated pattern (700) overlap one another. The overlap involves upper corners of hexagonal cells (704) in a lower row overlapping the lower corners of hexagonal cells (704) in a higher row, where the lower and higher row are adjacent. The distance of overlap is shown in FIG. 7A by callout (714). Similarly, the columns (708) of the tessellated pattern (700) also overlap one another. The overlap involves side corners of the hexagonal cells (704) of adjacent columns (708) overlapping one another. The distance of overlap is shown in FIG. 7A by callout (716).

Figure 7C:
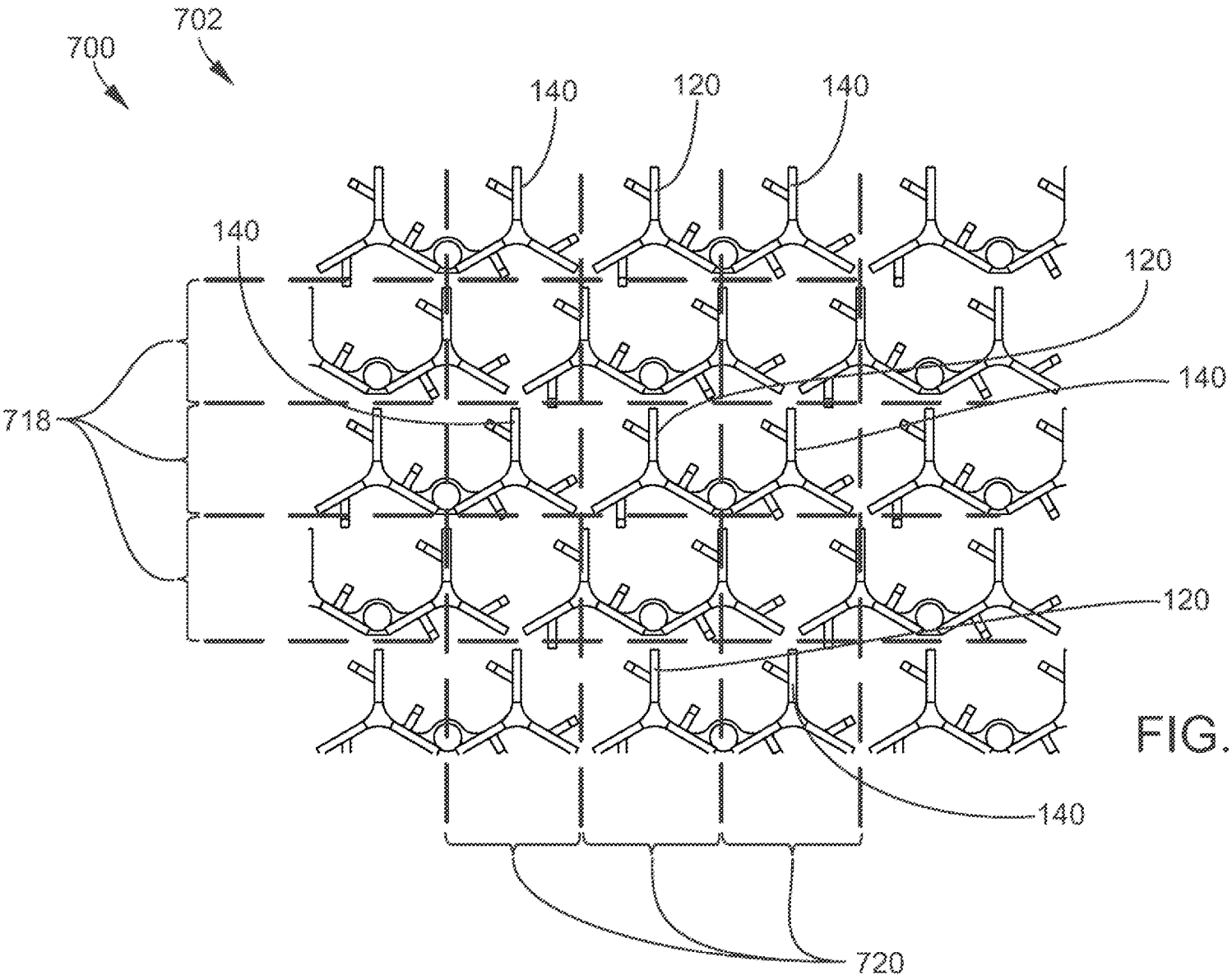

Referring to FIG. 7C, each of the three-anchor fin arrangements (120, 140) of each of the refractory anchors (100) is arranged in a tessellated pattern forming three-anchor fin arrangement rows (718) and three-anchor fin arrangement columns (720). The rows (718) are formed of a set of co-linear or aligned (or substantially co-linear) arrangements (120, 140). The three-anchor fin arrangement rows (718) are formed by a pattern of alternating three-anchor fin arrangement (120) with three-anchor fin arrangement (140) and then another three-anchor fin arrangement (120) followed by another three-anchor fin arrangement (140) and so on. The row (718) is formed by refractory anchors (100) arranged side-by-side or adjacent to one another, and the order of arrangements (i.e., 120, 140, 120, 140, etc.) follows.

A three-anchor fin arrangement columns (720) is formed by a pattern of repeating arrangement (120), or in a different column (620), a pattern of repeating arrangement (140) forms the column (720). In other words, a single column (720) is made up only of arrangements (120) and does not include any arrangements (140). The adjacent columns (720) are both made up solely of arrangements (140). The columns (720) are formed of a set of co-linear or aligned (or substantially co-linear) arrangements (120, 140). Notably unlike the set of arrangements forming rows (718), the arrangements (120, 140) forming the columns (720) are spaced-apart or non-adjacent from one another, because they are separated by every other row (718).

Figure 7D:
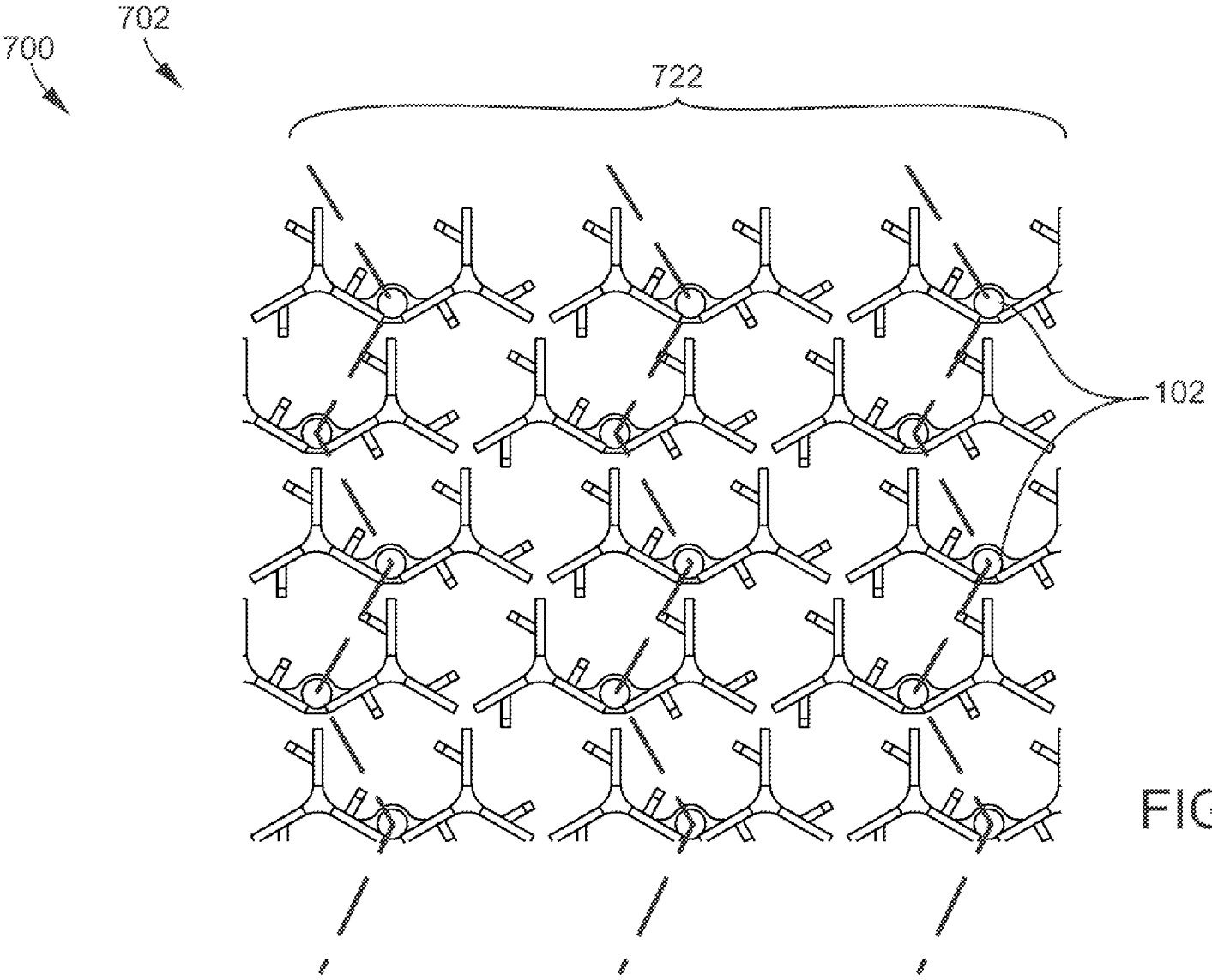

As shown in FIG. 7D, the mounting elements (102) of the refractory anchors (100) are arranged in a zig-zag tessellated pattern (722) when the anchoring system (702) is arranged in tessellated pattern (700). Similarly, the tessellated pattern may be characterized based on the hexagonal cells (704) themselves rather than the mounting elements (102). Namely, as shown in FIG. 7D, the tessellated pattern (700) of the refractory anchors (100) may be characterized in that the hexagonal cells (704) are arranged in a zig-zag tessellated pattern (722). More specifically, the two-opening cells (732) are arranged in a zig-zag tessellated pattern (722), and the three-opening cells (734) are likewise arranged in a zig-zag tessellated pattern (722).

Figure 7E:
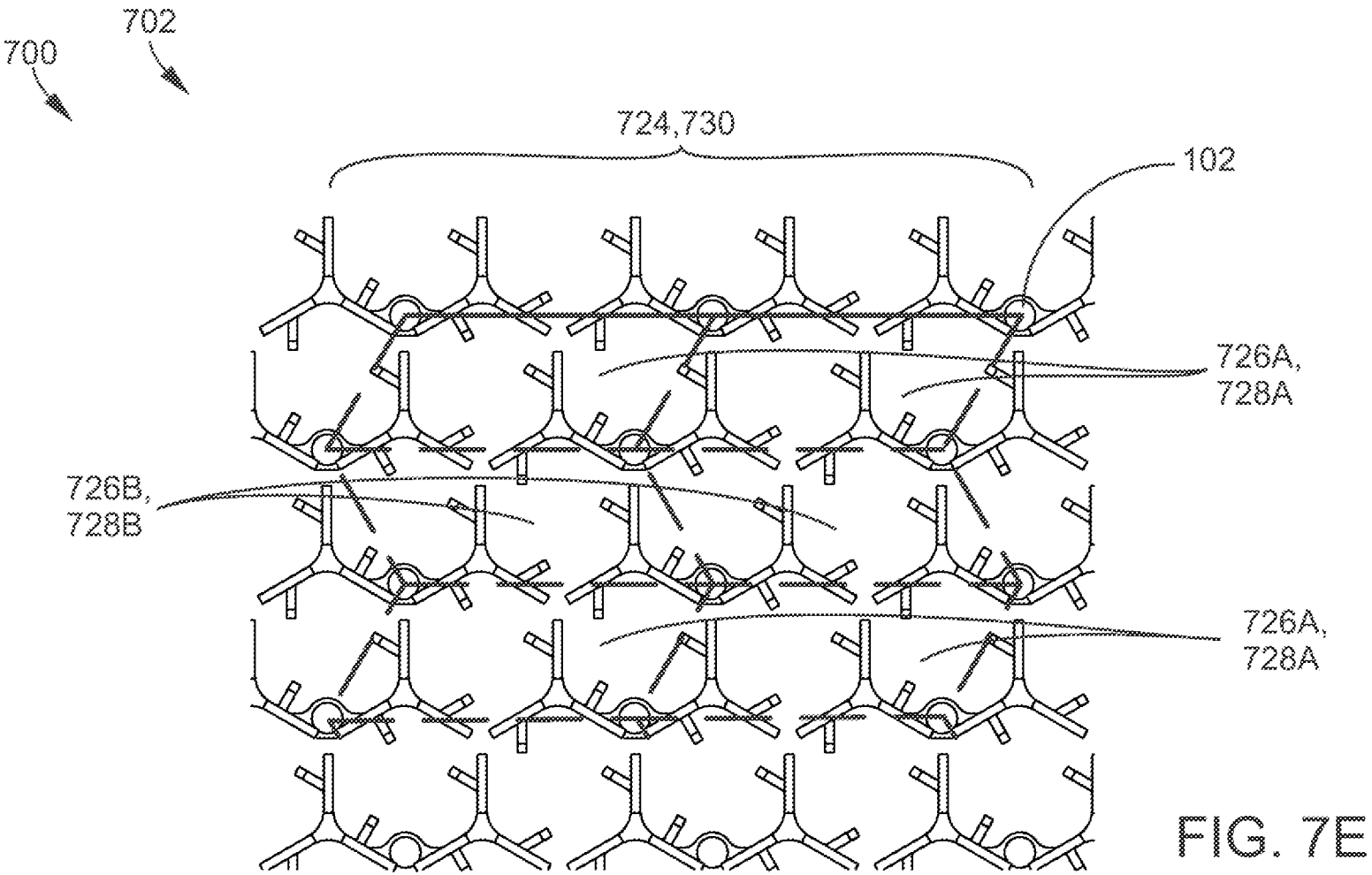

As shown in FIG. 7E, the mounting elements (102) of the refractory anchors (100) are also arranged in a parallelogram tessellated pattern (724) formed of a plurality of parallelograms (726A, 726B) arranged adjacent to one another and in opposing orientations. Namely, parallelograms (726A) are oriented in a first direction and parallelograms (726B) are oriented in a second direction opposite the first direction. In other words, half the parallelograms (726A) shown in FIG. 7E are in a dissimilar orientation in relation to the other half of the parallelograms (726B). In some implementations of the tessellated pattern (700), the mounting elements (102) are arranged in a rhomboid tessellated pattern (730) formed by a plurality of rhomboids (728A, 728B) arranged adjacent to one another and in opposing orientations. Namely, rhomboids (728A) are oriented in a first direction and rhomboids (728B) are oriented in a second direction opposite the first direction. In other words, half the rhomboids (728A) shown in FIG. 7E are in a dissimilar orientation in relation to the other half of the rhomboids (728B).

Figure 7F:
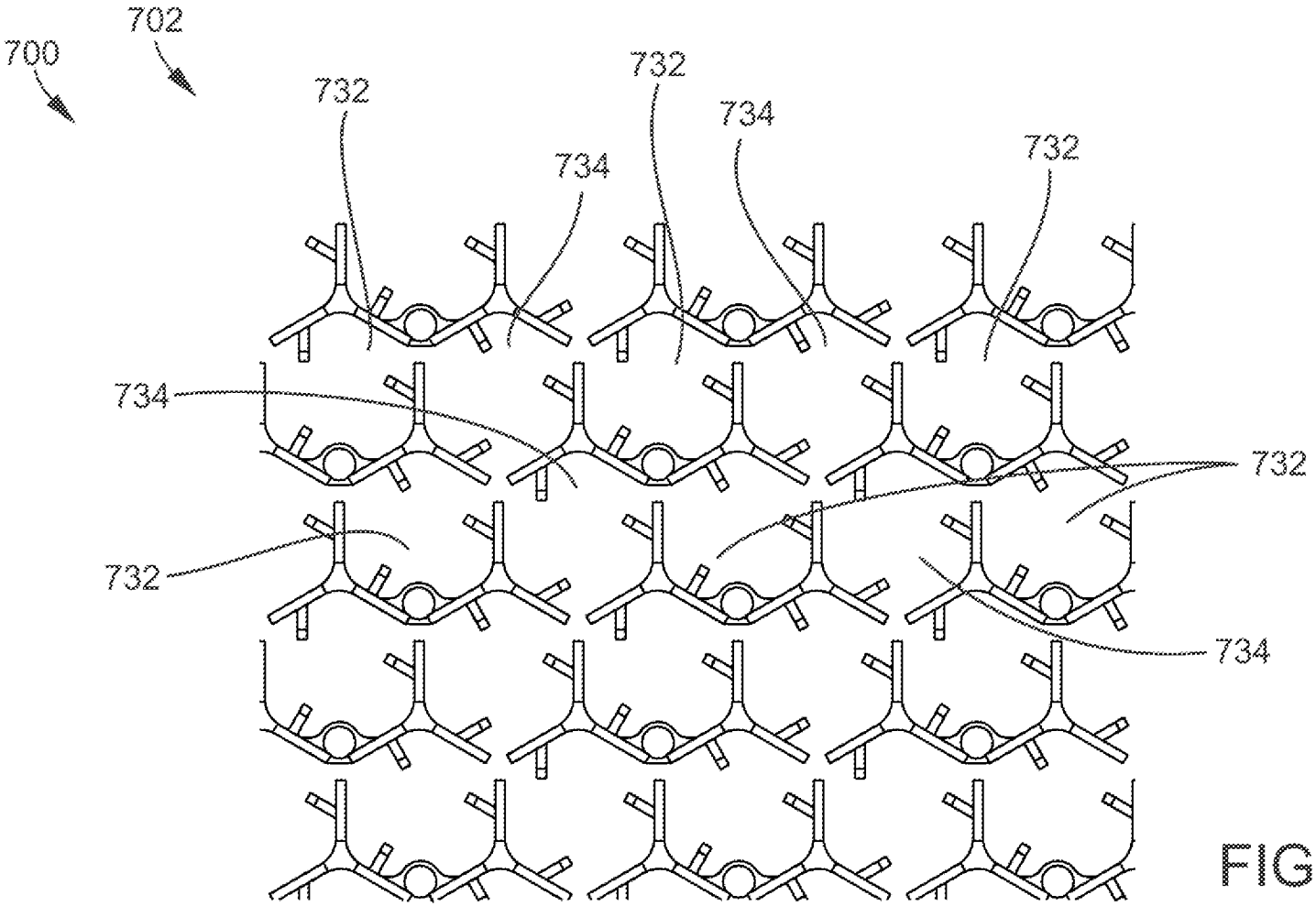

Referring now to FIG. 7F half or substantially half of the plurality of hexagonal cells (704) of the tessellated pattern (700) is made up of two-opening cells (732). Likewise, half or substantially half of the plurality of hexagonal cells (704) of the tessellated pattern (700) is made up of three-opening cells (734). Each hexagonal cell such as the two-opening cells (732) and/or the three-opening cells (734) may have one, two, three or more fins (122) extending from the anchors (100) into the hexagonal cells (704).

Figure 7G:
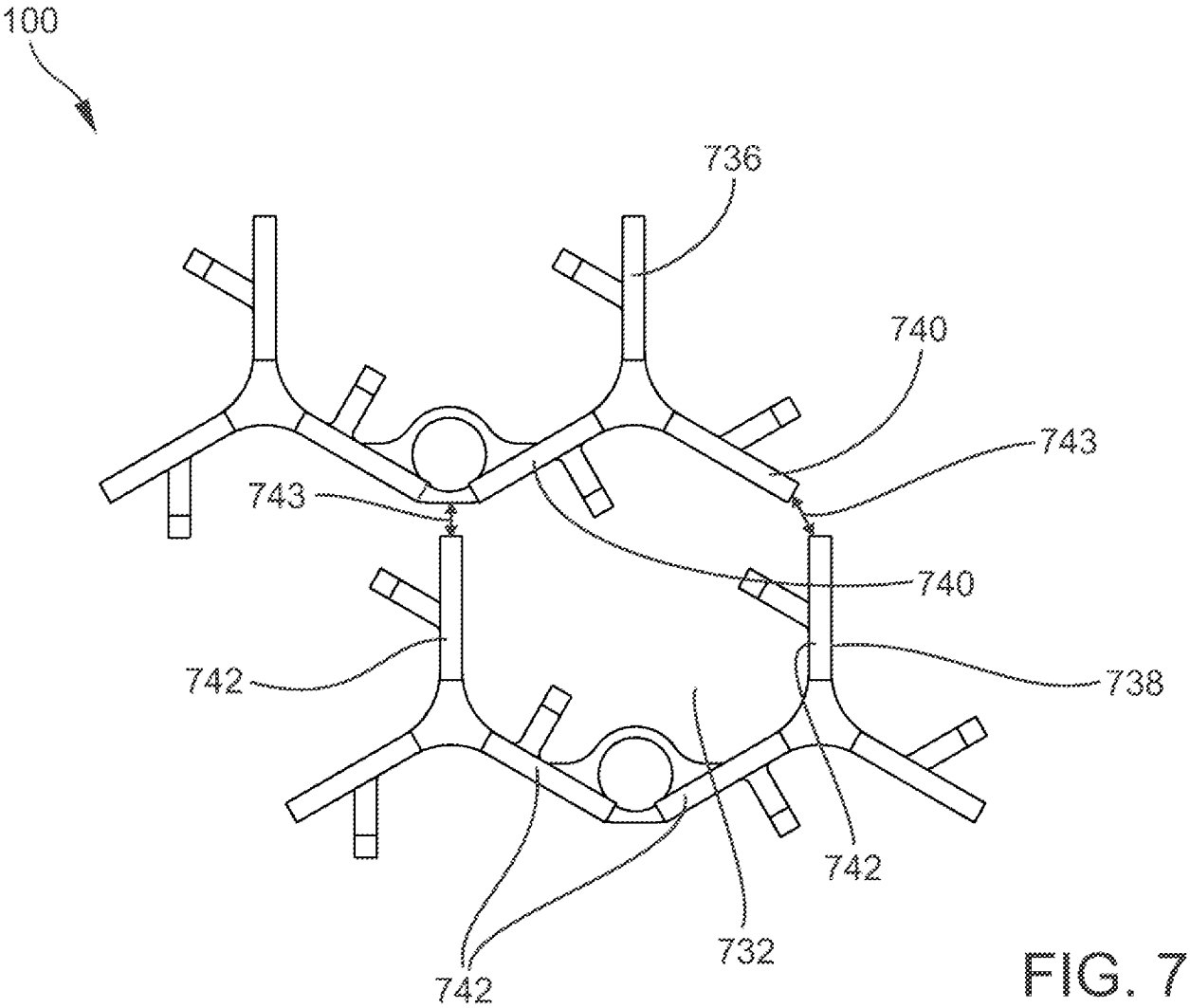

As shown in FIG. 7G, the two-opening cells (732) are formed by two refractory anchors proximate one another. A first refractory anchor (736) of the two anchors forms two sides (740) of the two-opening cell (732). A second refractory anchor (738) of the two anchors forms four sides (742) of the two-opening cell (732). Two openings (743) are defined between the first refractory anchor (736) and the second refractory anchor (738). In certain embodiments of the two-opening cell (732) a mounting element (102) of the second of the two refractory anchors (738) is disposed within the two-opening cell (732). In some embodiments, it is connected near the center of the four sides (742) and extends into the space of the two-opening cell (732).

Figure 7H:
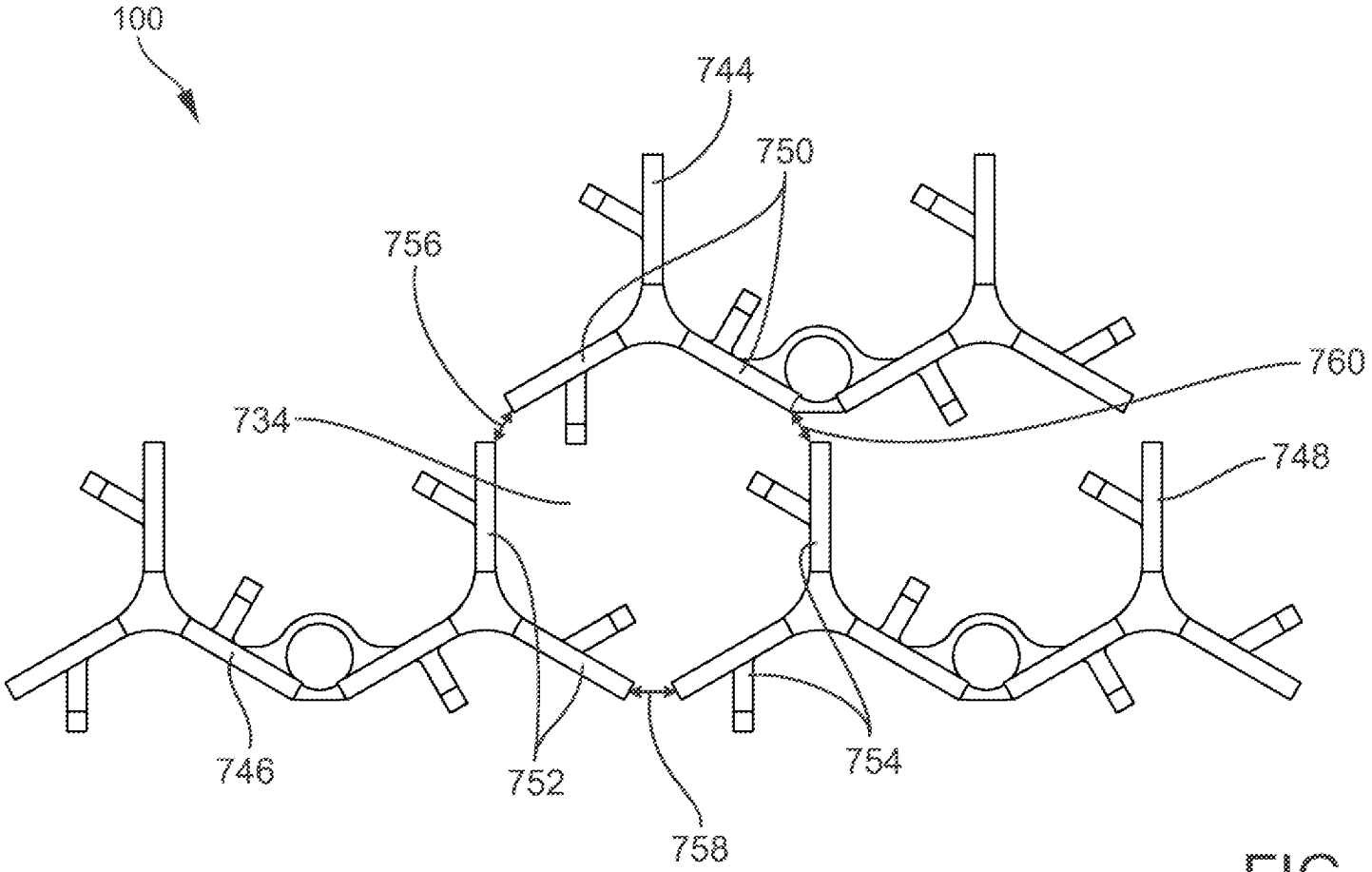

Referring to FIG. 7H, a three-opening cell (734) is formed of a first refractory anchor (744), a second refractory anchor (746), and a third refractory anchor (748) that are arranged proximate to one another. The first anchor (744) forms a first two sides (750) of the three-opening cell (734), the second anchor (746) forms a second two sides (752) of the three-opening cell (734), and the third anchor (748) forms a third two sides (754) of the three-opening cell (734). A first of three openings (756) is defined by the first anchor (744) and the second anchor (746), a second opening (758) is defined by the second anchor (746) and the third anchor (748) and a third opening (760) is defined by the third anchor (748) and the first anchor (744). As shown in FIG. 7H, the three-opening cell (734) does not have a mounting element inside it, or in other words, no mounting element is disposed such that it extends from any anchor into the interior space of the three-opening cell (734).

Referring now to FIGS. 8A-8H (collectively referred to herein as "FIG. 8"), an anchoring system (802) arranged in a tessellated pattern (800) is illustrated. The anchoring system (802) is configured for anchoring a refractory material for lining a thermal vessel. The anchoring system (802) includes a plurality of refractory anchors (100) such as those discussed in detail above. The refractory anchors (100), as discussed above, include a mounting element (102), two three-anchor fin arrangements (120, 140) that are each directly connected to the mounting element (102) as discussed above, such as by one of three anchor fins (121, 141). The refractory anchors (100) may optionally include one or more reinforcement fins (122) also discussed above.

As shown in FIG. 8, the refractory anchors (100) of the anchoring system (802) are arranged in an ordered array of chevron cells (804), chevron-shaped cells, or substantially chevron-shaped cells in a tessellated pattern (800). The tessellated pattern (800) forms rows (806) and columns (808) of chevron cells (804). In other words, each chevron cell (804) of the tessellated pattern (800) is part of a row (806) and is also part of a column (808).

Figure 8A:
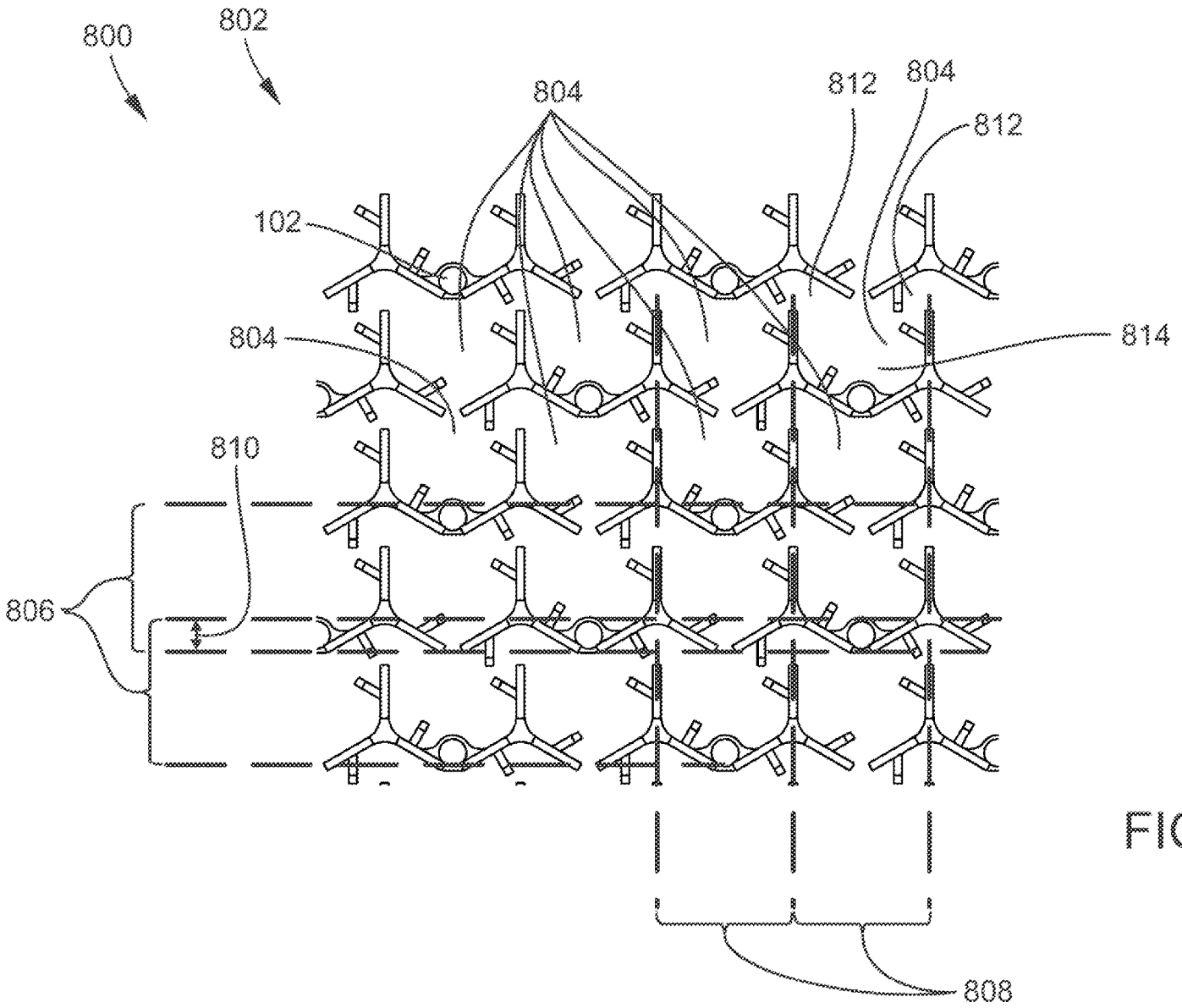
FIGS. 8A, 8B, 8C, 8D, 8E, 8F, 8G, and 8H are each overhead views of a chevron tessellated pattern of refractory anchors.
Figure 8B:
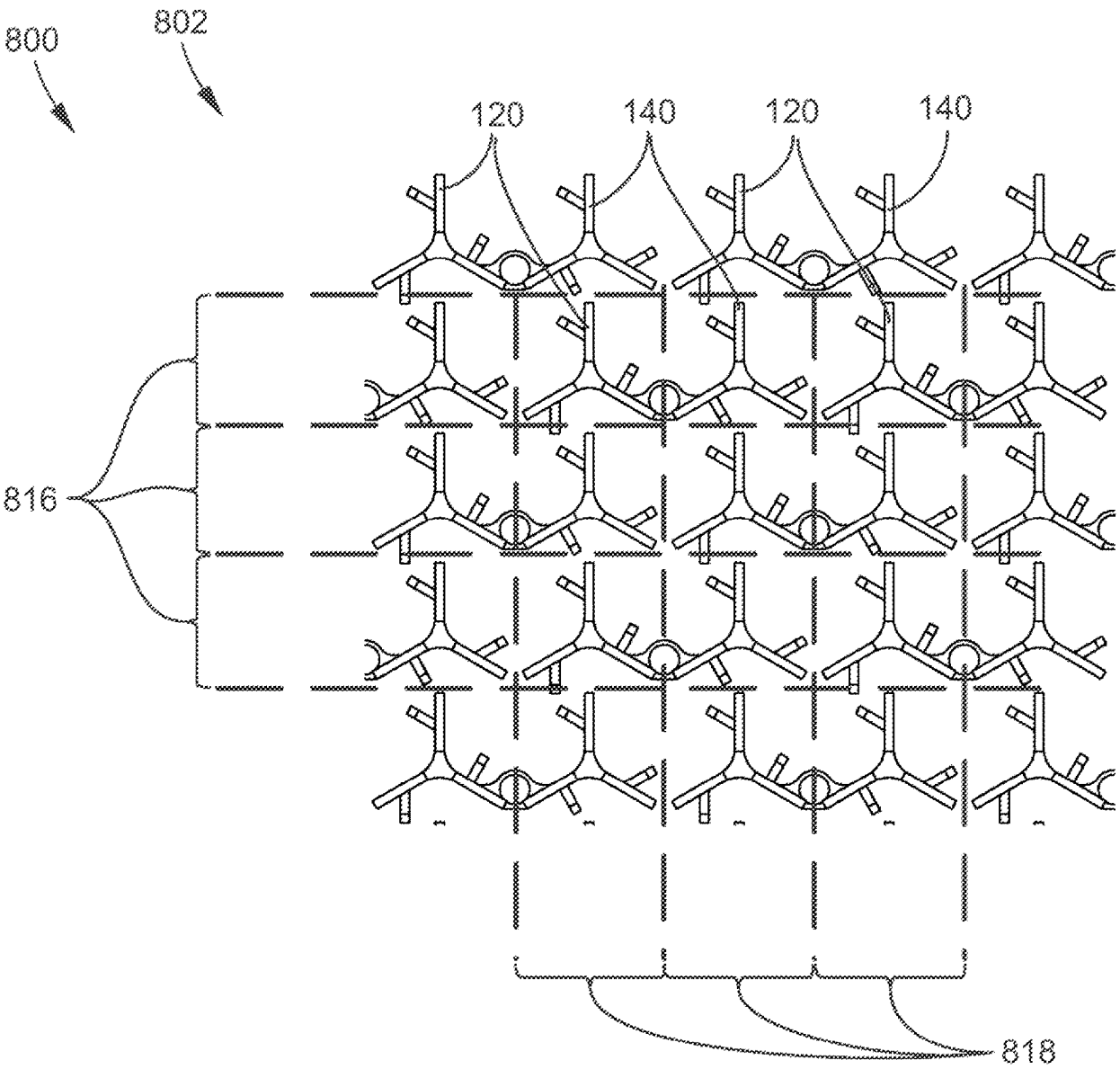

As shown in FIG. 8B, each column (808) includes a set of the chevron cells (804), and each row (806) includes a set of the chevron cells (804). The set of chevron cells (804) of a column (808) are aligned or co-linear (or substantially co-linear) and are adjacent (or substantially adjacent) to one another, or in other words are side-by-side to one another. Each row (806) includes a set of the chevron cells (804). The set of chevron cells (804) of a row (806) are aligned or co-linear (or substantially co-linear) and are arranged adjacent (or substantially adjacent) to one another, or in other words are side-by-side to one another.

Referring specifically to FIG. 8A, the rows (806) of the tessellated pattern (800) overlap one another. The overlap involves upper corners or tails or tail portions (812) of chevron cells (804) in a lower row overlapping the lower corners or head or head portion (814) of chevron cells (804) in a higher row, where the lower and higher row are adjacent. The distance of overlap is shown in FIG. 8A by callout (810). Notably, distinct from the embodiments discussed above with reference to FIGS. 6 and 7, the embodiment of FIG. 8 has adjacent columns formed of adjacent chevron cells (804) that do not overlap. In the embodiment shown, the sides of adjacent chevron cells (804) are both defined by and share the same boundary, but are considered not to overlap.

Referring to FIG. 8B, each of the three-anchor fin arrangements (120, 140) of each of the refractory anchors (100) is arranged in a tessellated pattern forming three-anchor fin arrangement rows (816) and three-anchor fin arrangement columns (818). The rows (816) are formed of a set of co-linear or aligned (or substantially co-linear) arrangements (120, 140). The three-anchor fin arrangement rows (816) are formed by a pattern of alternating three-anchor fin arrangement (120) with three-anchor fin arrangement (140) and then another three-anchor fin arrangement (120) followed by another three-anchor fin arrangement (140) and so on. The row (816) is formed by refractory anchors (100) arranged side-by-side or adjacent to one another, and alternating the order of arrangements (i.e., 120, 140, 120, 140, etc.) follows.

A three-anchor fin arrangement column (818) is formed by a pattern of alternating arrangements (120) with arrangements (140). The adjacent columns (818) are both made up solely of arrangements (140) alternating with arrangements (120) (i.e., 140, 120, 140, 120, etc.) so that the alternating order of arrangements discussed above for rows (816) is likewise maintained. The columns (818) are formed of a set of co-linear or aligned (or substantially co-linear) arrangements (120, 140). Notably like the set of arrangements forming rows (816), the arrangements (120, 140) forming the columns (818) are adjacent with one another. In other words, the arrangements (120, 140) are side-by-side to one another.

Figure 8C:
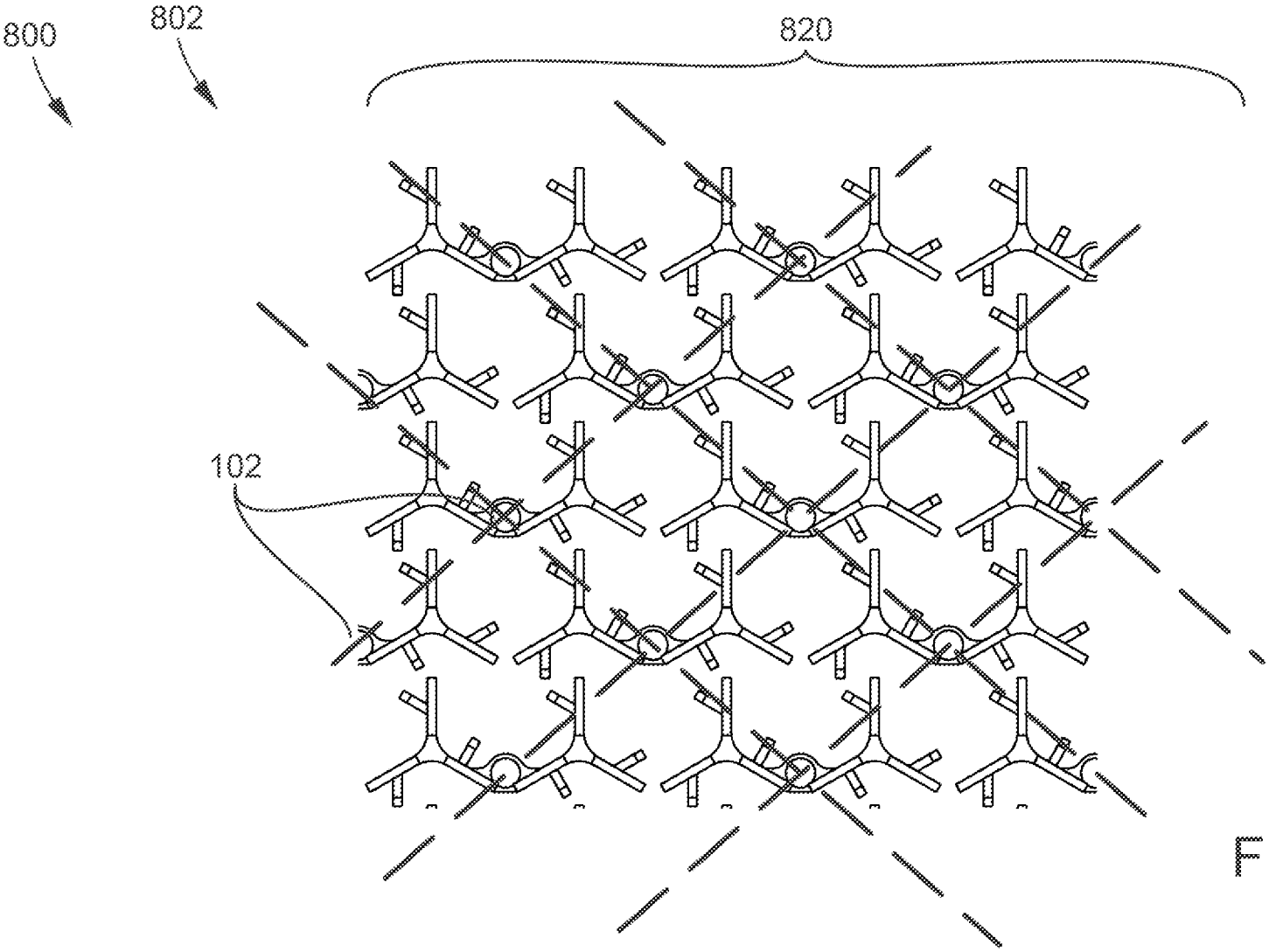

As shown in FIG. 8C, the mounting elements (102) of the refractory anchors (100) are arranged in a diagonal tessellated pattern (820). The diagonals of the pattern (820) may be drawn upward from left to right or upward from right to left. In other words, the pattern (820) forms diagonals in both directions. The diagonals together, in fact, form parallelograms, rhomboids, or possibly rhombuses, and so the pattern (820) could be characterized as a parallelogram tessellated pattern, a rhomboid tessellated pattern, and in the event the definition of a rhombus (i.e., that all the sides are equal length) is met, could be characterized as a rhombus tessellated pattern.

Figure 8D:
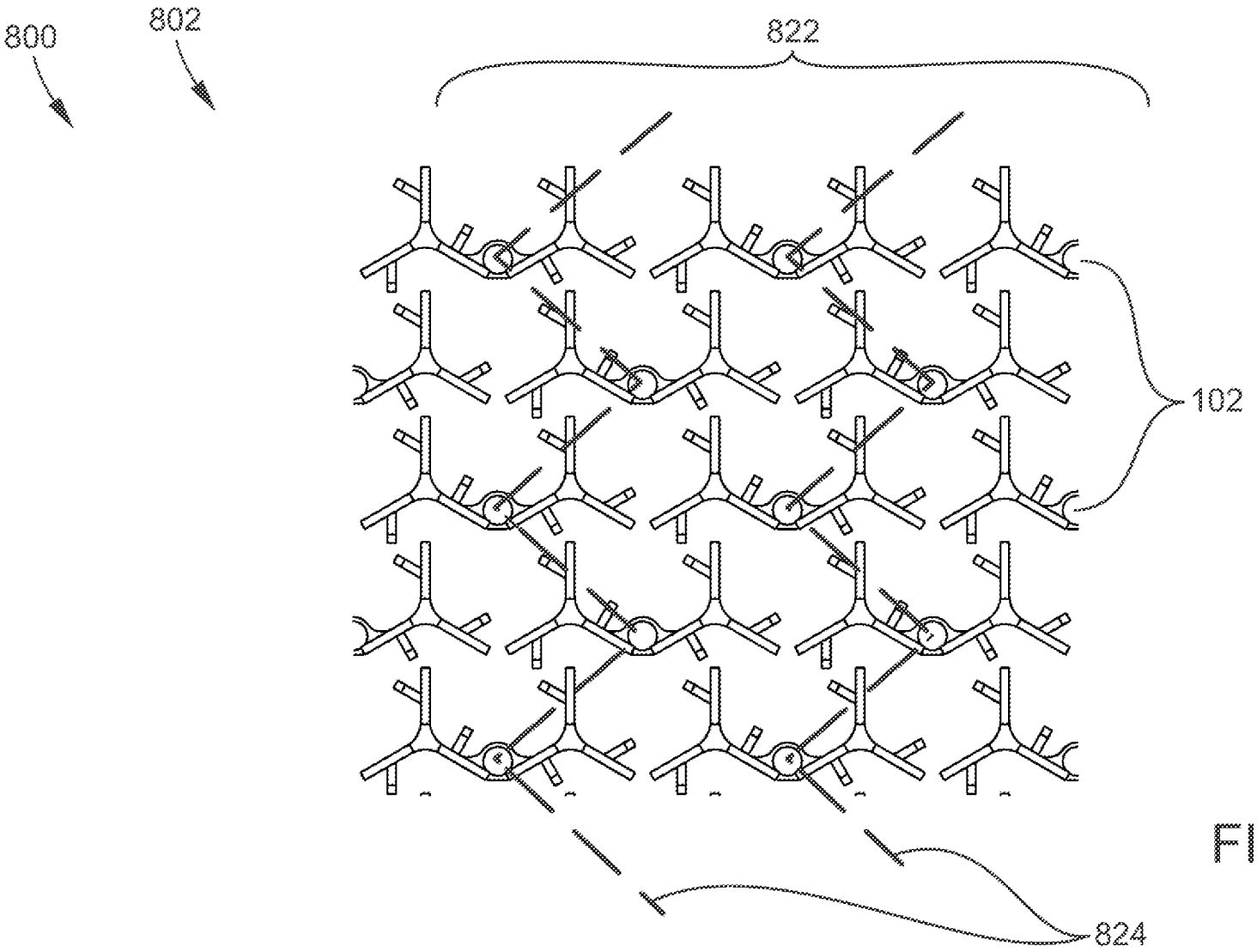

As shown in FIG. 8D, the mounting elements (102) of the refractory anchors (100) are arranged in a zig-zag tessellated pattern (822) when the anchoring system (802) is arranged in tessellated pattern (800). Similarly, the tessellated pattern (800) may be characterized based on the chevron cells (804) themselves rather than the mounting elements (102). Namely, as shown in FIG. 8D, the tessellated pattern (800) of the refractory anchors (100) may be characterized in that the chevron cells (804) are arranged in a zig-zag tessellated pattern (822). More specifically, the two-opening cells (832) are arranged in a zig-zag tessellated pattern (822), and the three-opening cells (834) are likewise arranged in a zig-zag tessellated pattern (822). The zig-zag tessellated pattern (822) is made up of a number of zig-zags (824) that are generally parallel, substantially parallel or parallel to one another as well as to the columns (808) of the tessellated pattern (800) of the refractory anchors (100).

Figure 8E:
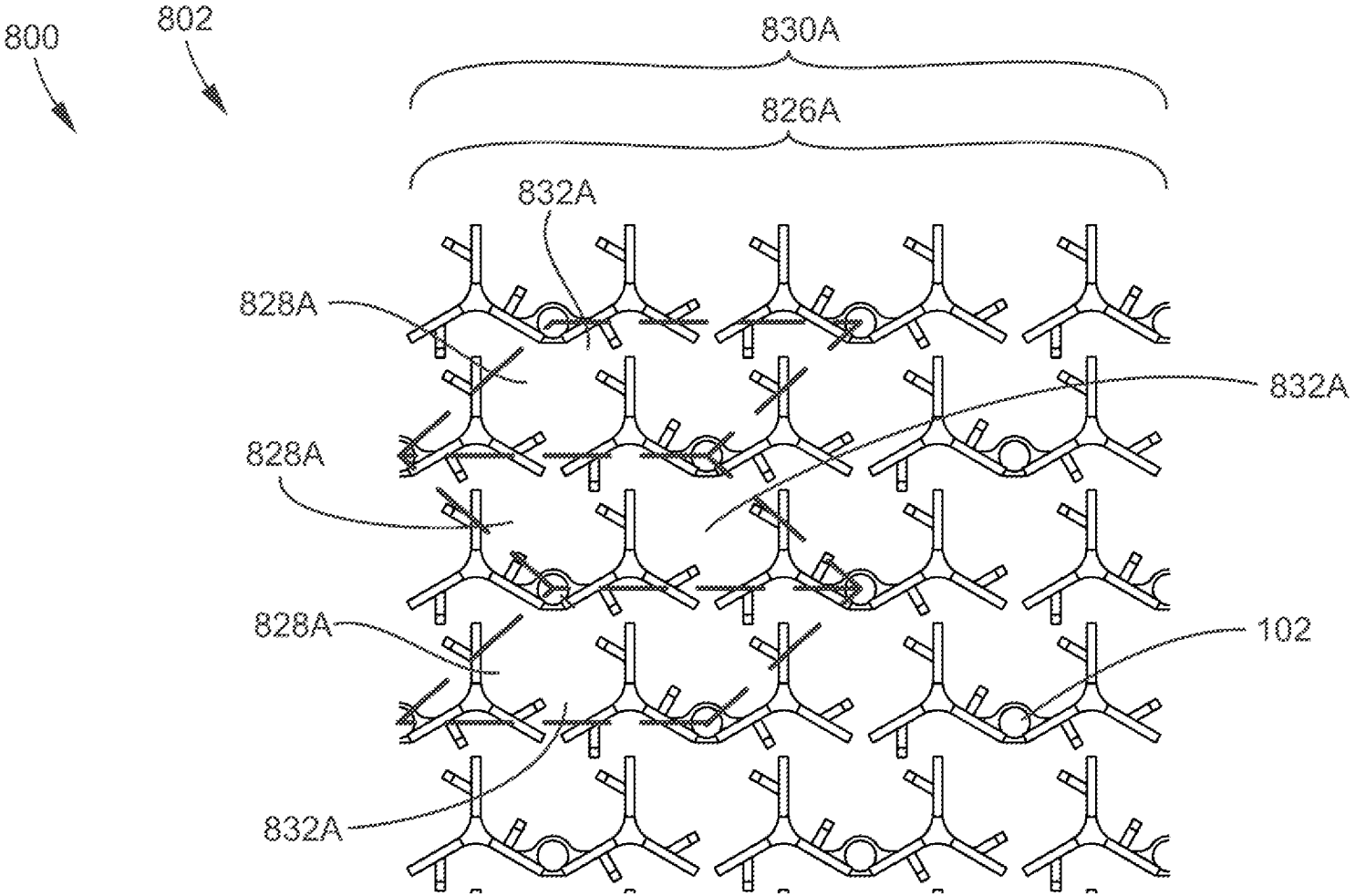

As shown in FIG. 8E, the mounting elements (102) of the refractory anchors (100) are also arranged in a parallelogram tessellated pattern (826A) formed of a plurality of parallelograms (826A, 826B) arranged adjacent to one another and in opposing orientations. Namely, parallelograms (826A) are oriented in a first direction and parallelograms (826B) are oriented in a second direction opposite the first direction. In other words, half the parallelograms (826A) of the parallelogram tessellated pattern (826A), as illustrated in FIG. 8E are in a dissimilar orientation in relation to the other half of the parallelograms (826B). In some implementations of the tessellated pattern (800), the mounting elements (102) are arranged in a rhomboid tessellated pattern (830A) formed by a plurality of rhomboids (832A, 832B) arranged adjacent to one another and in opposing orientations. Namely, rhomboids (832A) are oriented in a first direction and rhomboids (832B) are oriented in a second direction opposite the first direction. In other words, half the rhomboids (832A) shown in FIG. 8E are in a dissimilar orientation in relation to the other half of the rhomboids (832B).

Figure 8F:
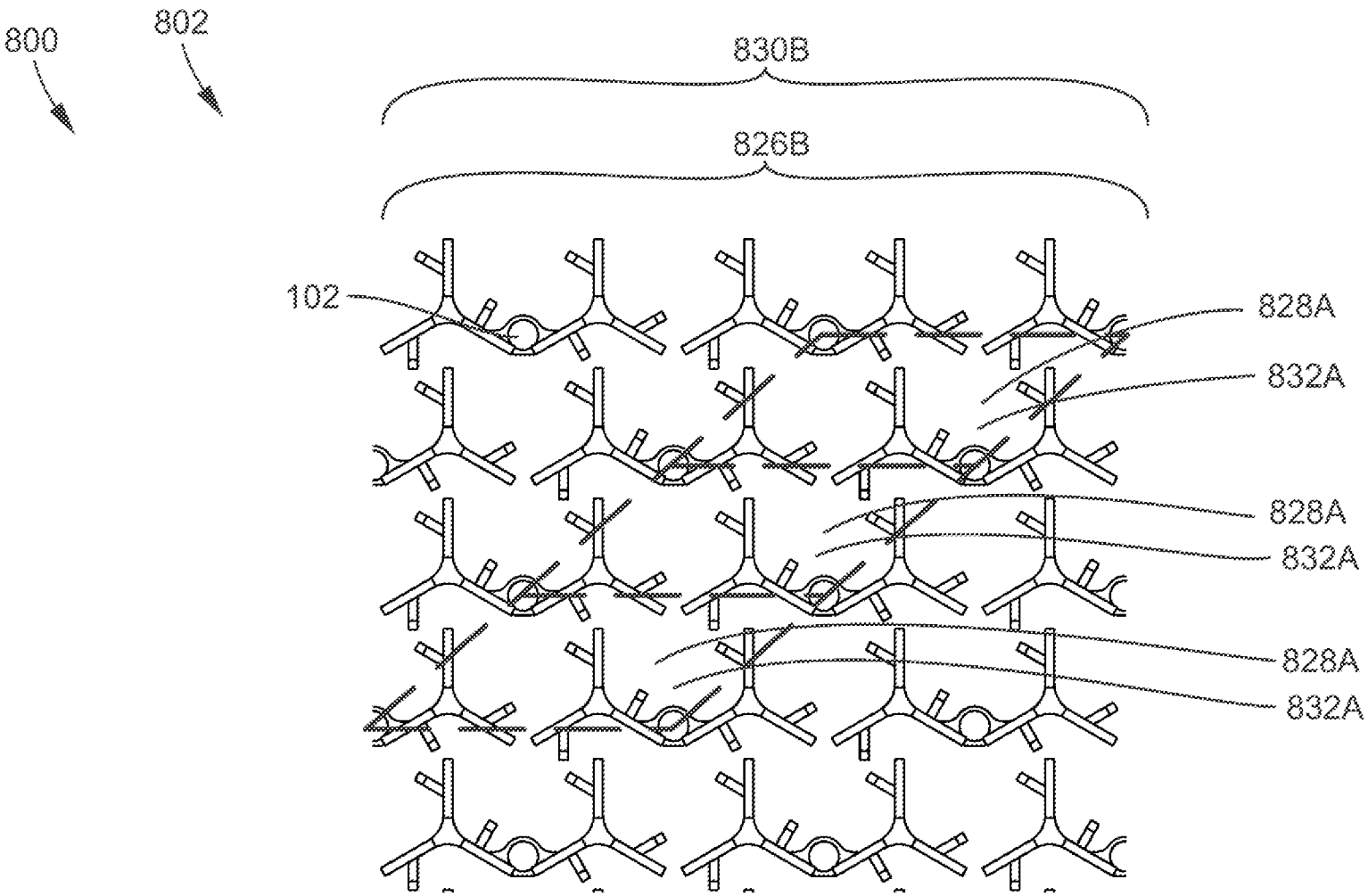

As shown in FIG. 8F, the mounting elements (102) of the refractory anchors (100) may also be characterized in a parallelogram tessellated pattern (826B) formed of a plurality of parallelograms (828A) arranged adjacent to one another and, as opposed to the parallelograms of FIG. 8E, in the same orientation. Namely, parallelograms (828A) are oriented in a certain direction and, in fact, all the parallelograms of the pattern (826B) are oriented in that same certain direction. In some implementations of the tessellated pattern (800), the mounting elements (102) are arranged in a rhomboid tessellated pattern (830B) formed by a plurality of rhomboids (832A) arranged adjacent to one another and in the same orientation. Namely, rhomboids (832A) are oriented in a certain direction, and in fact, all the rhomboids of the pattern (830B) are oriented in that same certain direction.

Figure 8G:
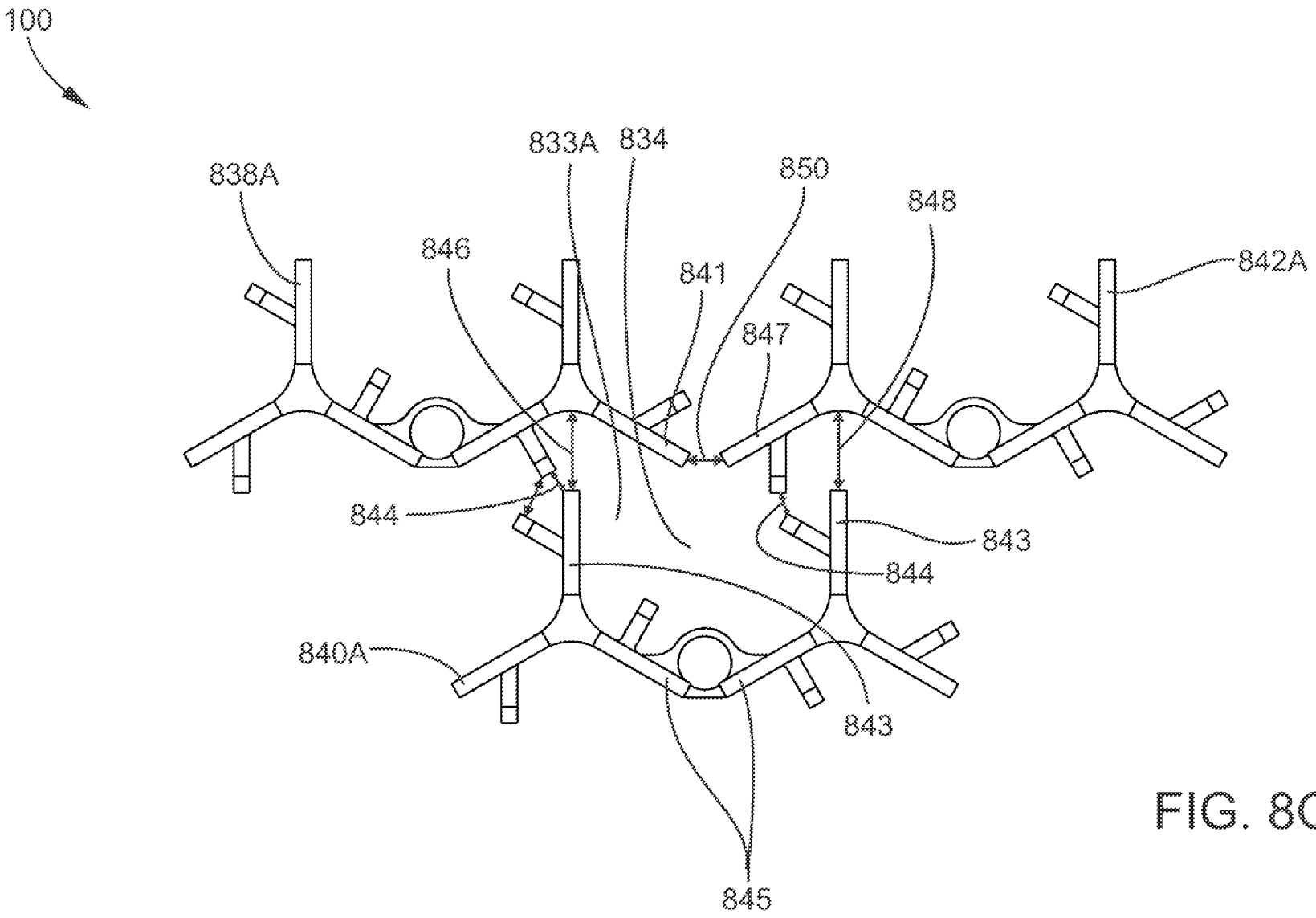
Figure 8H:
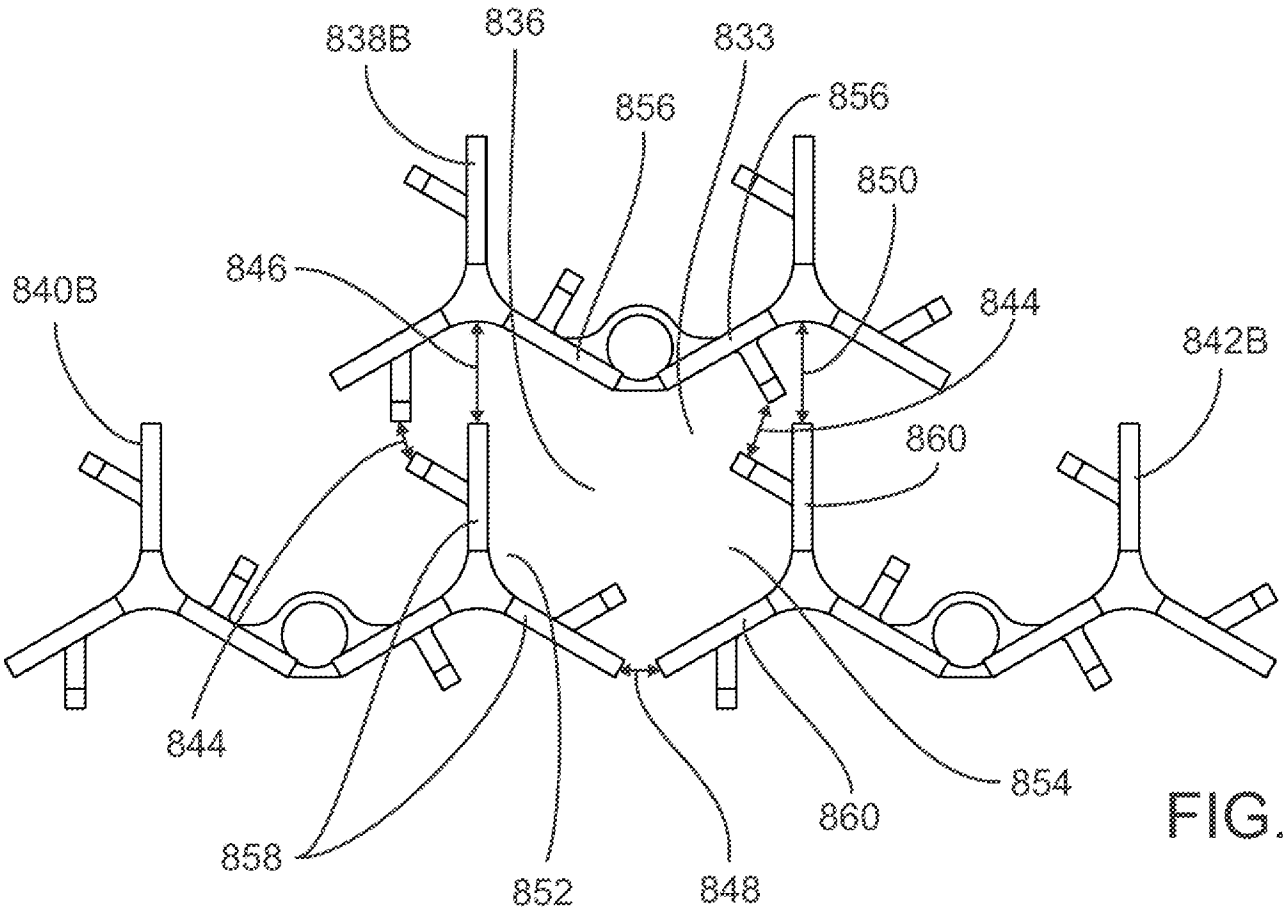

Referring now to FIG. 8G all or substantially all of the plurality of chevron cells (804) of the tessellated pattern (800) are made up of three-opening cells (833A, 833B). The three-opening cell (833A) shown in FIG. 8G is a first type (834), and the three-opening cell (833B) shown in FIG. 8H is a second type (836). Each chevron cell (804) may have one, two, three or more fins (122) extending from the anchors (100) into the chevron cells (804).

As shown in FIG. 8G, a first type (834) of the three-opening cells (833A) is formed by three refractory anchors (100) proximate one another. A first refractory anchor (838A) of the three anchors forms one side (841) of the chevron cell (804) and is proximate a tail (812) of the three-opening cell (833A). A second refractory anchor (840A) of the three anchors forms four sides, two sides (845) of which are proximate a head (814) of the three-opening cell (833A), and two sides (843) of which are proximate the tail (812) of the three-opening cell (833A). A first of three openings (846) is defined between the first refractory anchor (838A) and the second refractory anchor (840A), a second of three openings (848) is defined between the second refractory anchor (840A) and the third refractory anchor (842A), and a third of three openings (850) is defined between the third refractory anchor (842A) and the first refractory anchor (838A). In certain embodiments of the three-opening cell (833A) a mounting element (102) of the second of the two refractory anchors (840A) is disposed within the three-opening cell (833A). In some embodiments, it is connected near the intersection of the two sides (845) and extends into the space of the three-opening cell (833A). As shown in FIG. 8G, multiple fins may define fin openings (844) between adjacent three-opening cells (833A).

Referring to FIG. 8H, a second cell type (836) of three-opening cell (833B) is formed of a first refractory anchor (838B), a second refractory anchor (840B), and a third refractory anchor (842B) that are arranged proximate to one another. The first anchor (838B) forms a first two sides (856) of the three-opening cell (833B), the second anchor (840B) forms a second two sides (858) of the three-opening cell (833B), and the third anchor (842B) forms a third two sides (860) of the three-opening cell (833B). A first of three openings (846) is defined by the first anchor (838B) and the second anchor (840B), a second opening (848) is defined by the second anchor (840B) and the third anchor (842B) and a third opening (850) is defined by the third anchor (842B) and the first anchor (838B). As shown in FIG. 8H, the three-opening cell (833B) does not have a mounting element (102) inside it, or in other words, no mounting element (102) is disposed such that it extends from any anchor into the interior space of the three-opening cell (833B). A first shoulder (852) of the three-opening cell (833B) is defined proximate the intersection of the second two sides (858), and a second shoulder (854) is defined proximate the intersection of the third two sides (860).

Referring now to FIGS. 9A-9H (collectively referred to herein as "FIG. 9"), an anchoring system (902) arranged in a tessellated pattern (900) is illustrated. The anchoring system (902) is configured for anchoring a refractory material for lining a thermal vessel. The anchoring system (902) includes a plurality of refractory anchors (100) such as those discussed in detail above. The refractory anchors (100), as discussed above, include a mounting element (102), two three-anchor fin arrangements (120, 140) that are each directly connected to the mounting element (102) as discussed above, such as by one of three anchor fins (121, 141). The refractory anchors (100) may optionally include one or more reinforcement fins (122) also discussed above.

As shown in FIG. 9, the refractory anchors (100) of the anchoring system (902) are arranged in an ordered array of chevron cells (904), chevron-shaped cells, or substantially chevron-shaped cells in a tessellated pattern (900). The tessellated pattern (900) forms rows (906) and columns (908) of chevron cells (904). In other words, each chevron cell (904) of the tessellated pattern (900) is part of a row (906) and is also part of a column (908).

Figure 9A:
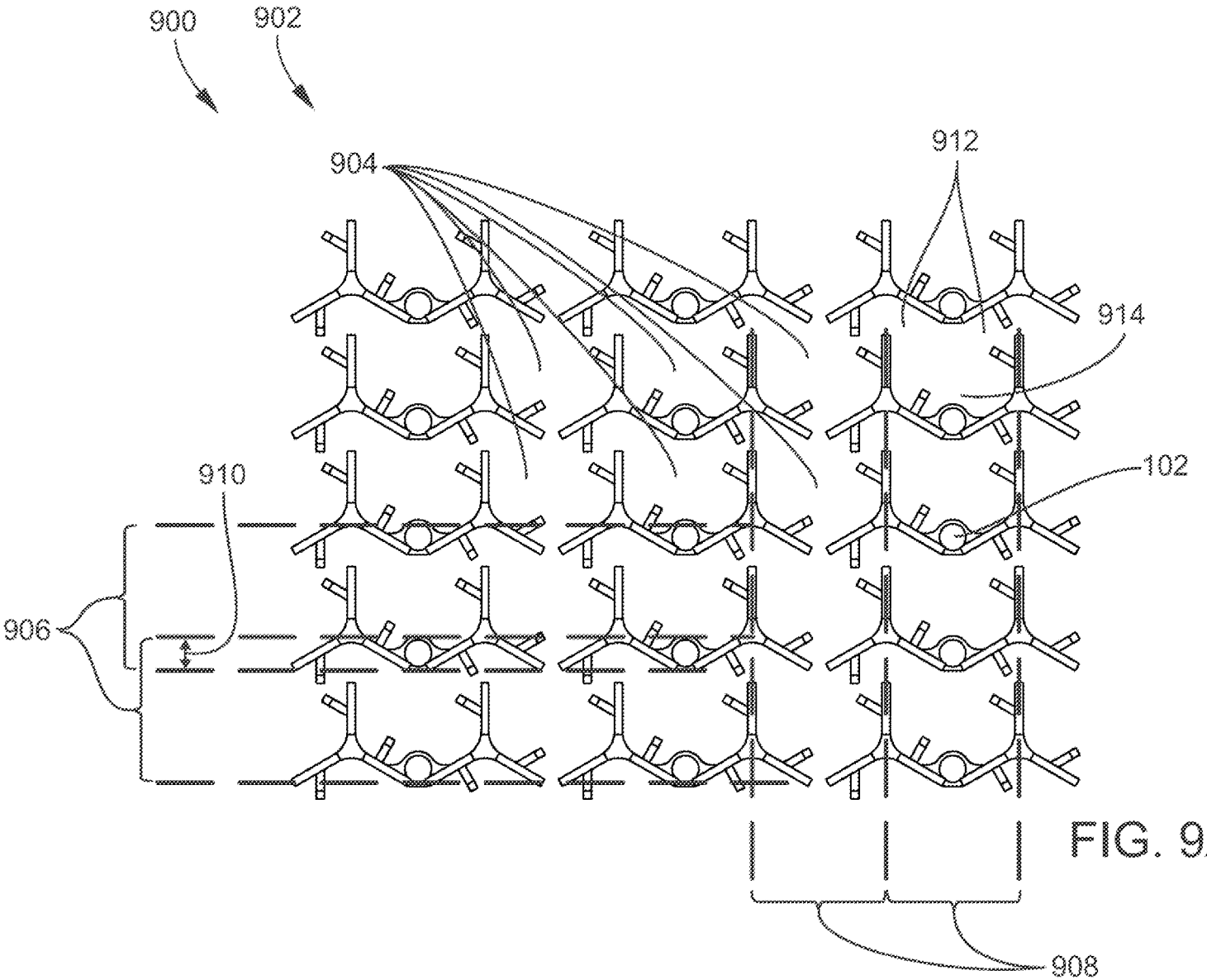
FIGS. 9A, 9B, 9C, 9D, and 9E are each overhead views of another chevron tessellated pattern of refractory anchors.
Figure 9B:
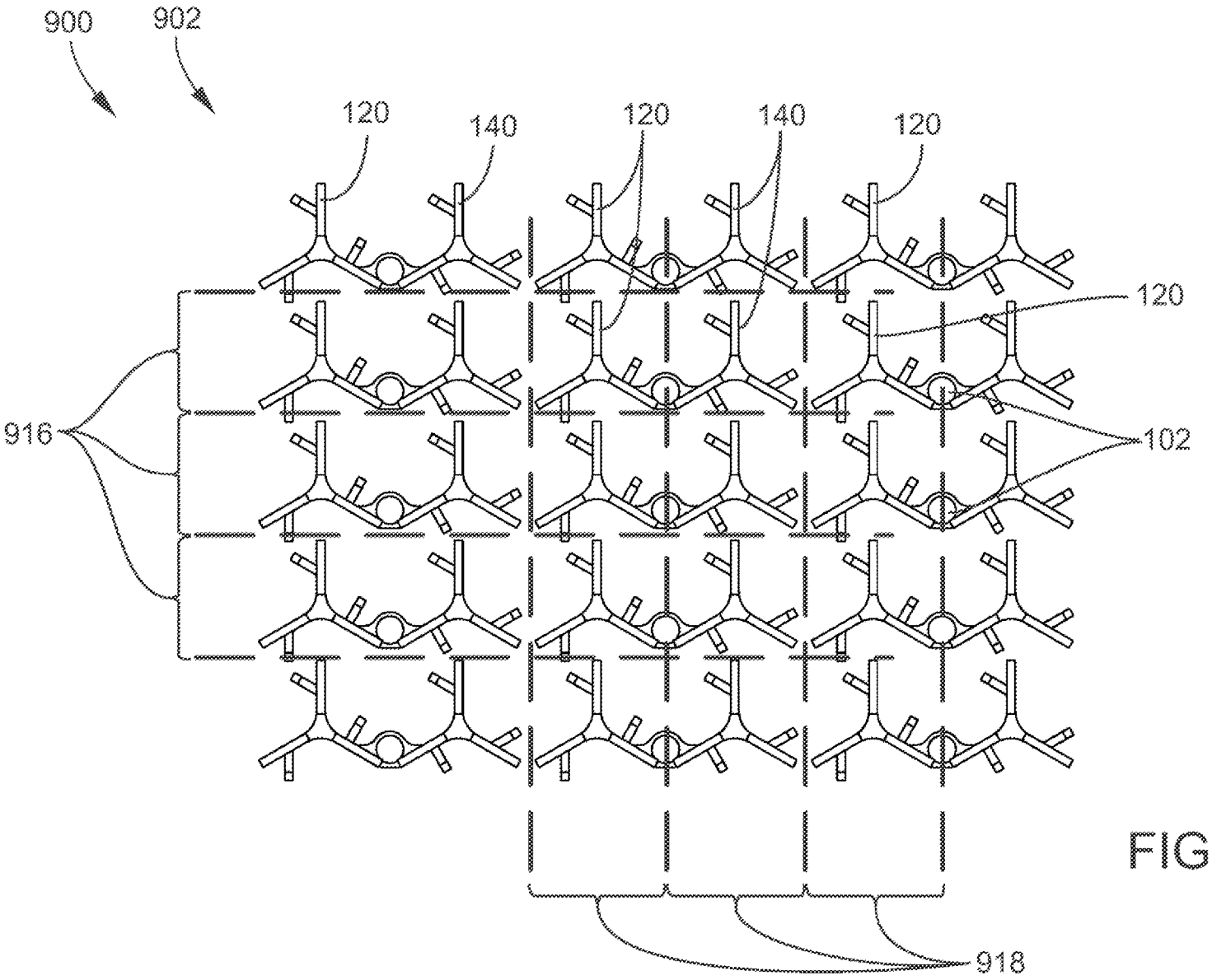

As shown in FIG. 9B, each column (908) includes a set of the chevron cells (904), and each row (906) includes a set of the chevron cells (904). The set of chevron cells (904) of a column (908) are aligned or co-linear (or substantially co-linear) and are adjacent (or substantially adjacent) to one another, or in other words are arranged side-by-side. Each row (906) includes a set of the chevron cells (904). The set of chevron cells (904) of a row (906) are aligned or co-linear (or substantially co-linear) and are arranged adjacent (or substantially adjacent) to one another, or in other words are arranged side-by-side.

Referring specifically to FIG. 9A, the chevron cells (904) of adjacent rows (906) of the tessellated pattern (900) overlap one another. The overlap involves upper corners or tails or tail portions (912) of chevron cells (904) in a lower row overlapping the lower corners or head or head portion (914) of chevron cells (904) in a higher row, where the lower and higher row are adjacent. The distance of overlap is shown in FIG. 9A by callout (910). Notably, distinct from the embodiments discussed above with reference to FIGS. 6 and 7, the embodiment of FIG. 9 has adjacent columns formed of adjacent chevron cells (904) that do not overlap. In the embodiment shown, the sides of adjacent chevron cells (904) are both defined by and share the same boundary, but are considered not to overlap.

Referring to FIG. 9B, each of the three-anchor fin arrangements (120, 140) of each of the refractory anchors (100) is arranged in a tessellated pattern (900) forming three-anchor fin arrangement rows (916) and three-anchor fin arrangement columns (918). The rows (916) are formed of a set of co-linear or aligned (or substantially co-linear) arrangements (120, 140). The three-anchor fin arrangement rows (916) are formed by a pattern of alternating three-anchor fin arrangement (120) with three-anchor fin arrangement (140) and then another three-anchor fin arrangement (120) followed by another three-anchor fin arrangement (140) and so on. Thus, the rows (916) are formed by refractory anchors (100) arranged side-by-side or adjacent to one another, and alternating the order of arrangements (i.e., 120, 140, 120, 140, etc.) follows.

A three-anchor fin arrangement column (918) is formed by a pattern of alternating arrangements (120) with arrangements (140). The adjacent columns (918) are both made up solely of arrangements (140) alternating with arrangements (120) (i.e., 140, 120, 140, 120, etc.) so that the alternating order of arrangements discussed above for rows (916) is likewise maintained. The columns (918) are formed of a set of co-linear or aligned (or substantially co-linear) arrangements (120, 140). Notably, like the set of arrangements forming rows (916), the arrangements (120, 140) forming the columns (918) are adjacent with one another. In other words, the arrangements are side-by-side with one another.

Figure 9C:
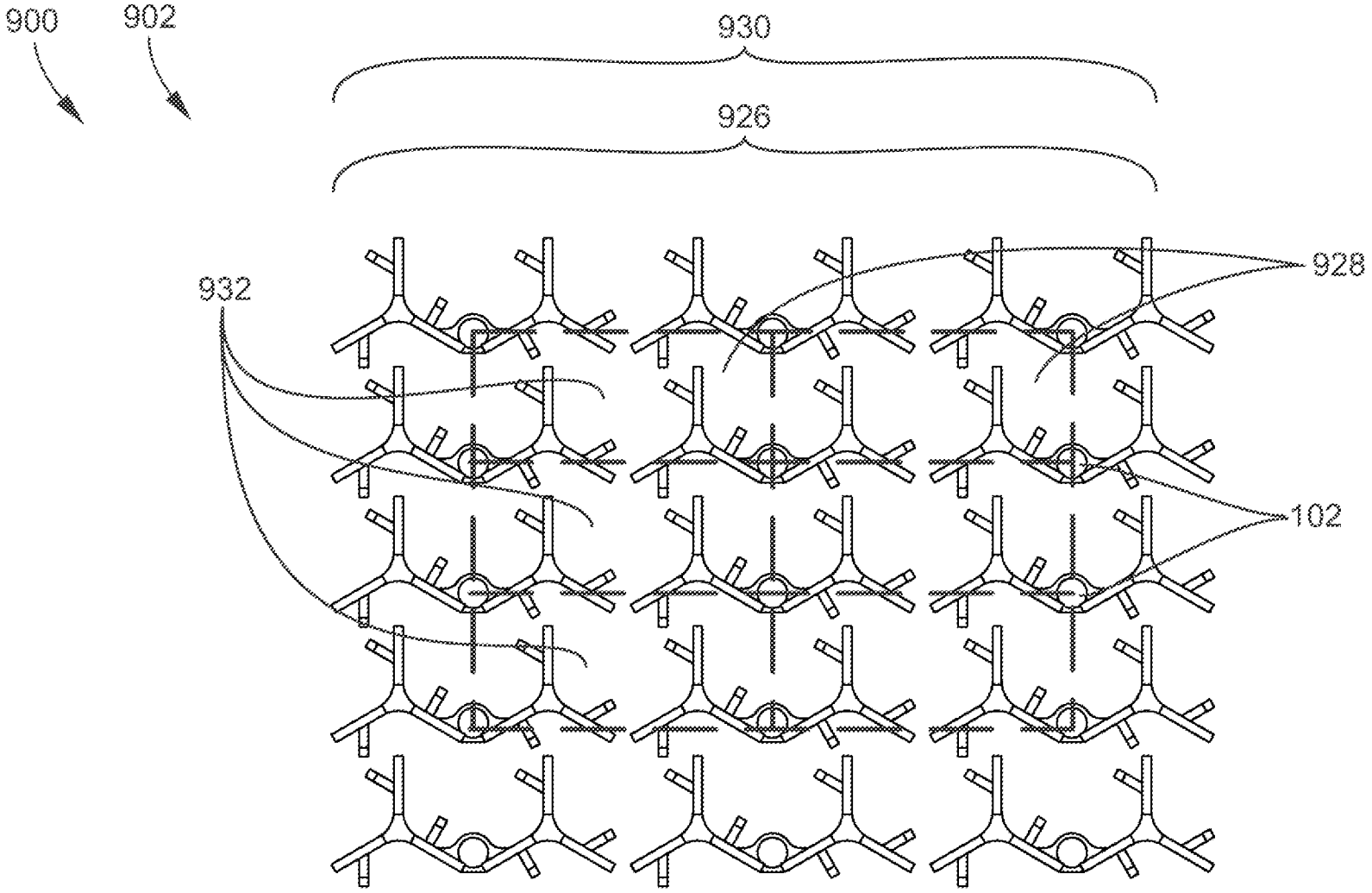

As shown in FIG. 9C, the mounting elements (102) of the refractory anchors (100) are arranged in a parallelogram tessellated pattern (926) formed of parallelograms (928). The lines of the pattern (926) are drawn up and down as well as left and right to form vertical or substantially vertical lines and horizontal or substantially horizontal lines, respectively, with the top of the page of FIG. 9C being up and the bottom of the page of FIG. 9C being down. The lines together, in fact, form parallelograms or rectangles, and so the pattern (926) could be characterized as a rectangular tessellated pattern (930) formed by rectangles (932).

Similarly, the tessellated pattern (900) may be characterized based on the chevron cells (904) themselves rather than the mounting elements (102). Namely, the tessellated pattern (900) of the refractory anchors (100) may be characterized in that the chevron cells (904) themselves are arranged in a parallelogram tessellated pattern (926) or a rectangular tessellated pattern (930). More specifically, two-opening cells (934), when considered by themselves, are arranged in a parallelogram or rectangular tessellated pattern, and four-opening cells (936) are likewise arranged in a parallelogram or rectangular tessellated pattern, when considered by themselves.

Half or substantially half of the plurality of chevron cells (904) of the tessellated pattern (900) are made up of two-opening cells (934). Likewise half or substantially half of the plurality of chevron cells (904) of the tessellated pattern (900) are made up of four-opening cells (936). Each chevron cell (904) may have one, two, three or more fins (122) extending from the anchors (100) into the chevron cells (904), and as shown in the embodiment of FIG. 9, the chevron cells (904) have three fins (122) each. The fins (122) may define fin openings (949, 958) between adjacent anchors (100).

Figure 9D:
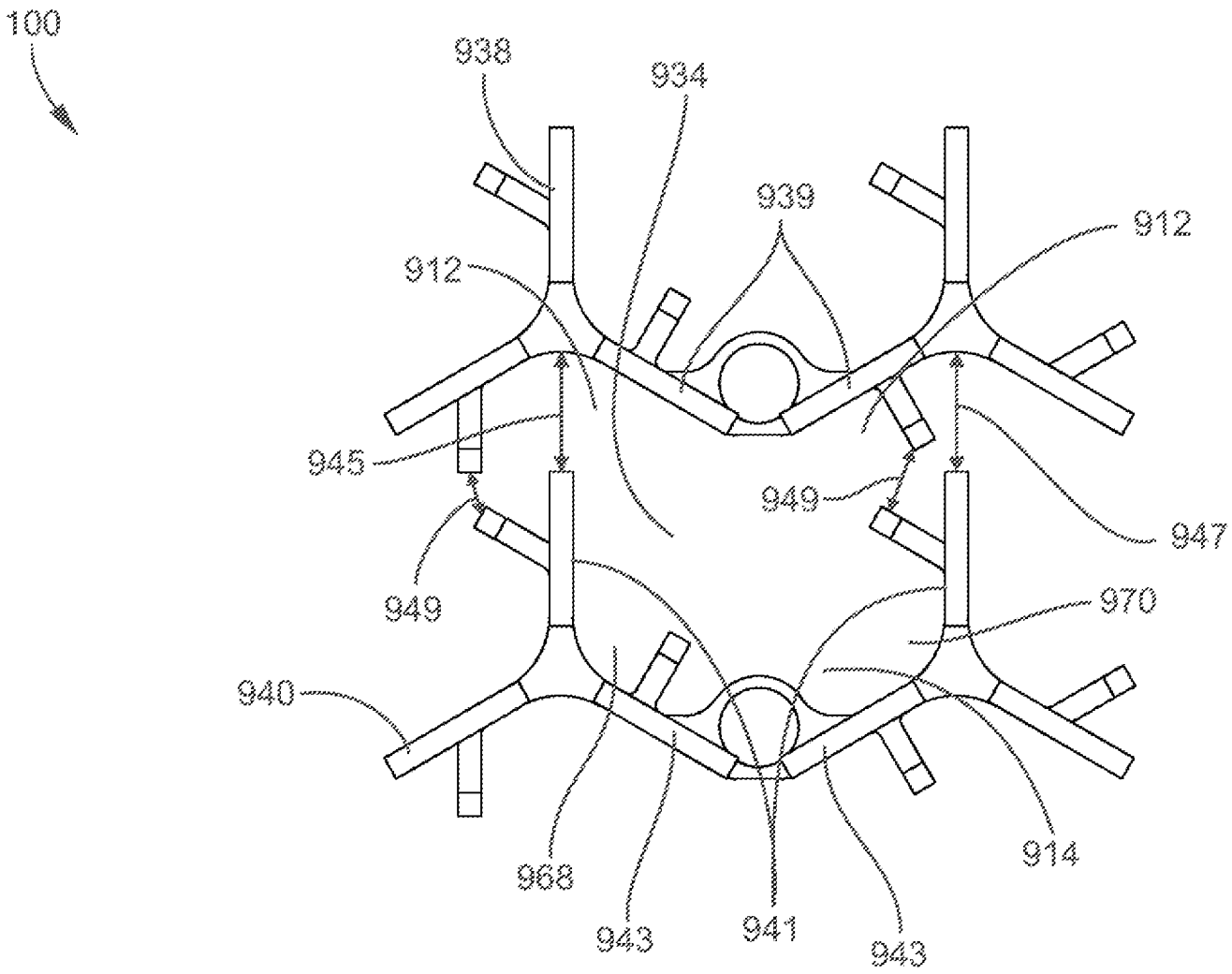

As shown in FIG. 9D, the two-opening cells (934) is formed by two refractory anchors (100) proximate one another. A first refractory anchor (938) of the two anchors forms two sides (939) of the chevron cell (904) and is proximate a tail (912) of the two-opening cell (934). A second refractory anchor (940) of the two anchors forms four sides, two sides (943) of which are proximate a head (914) of the two-opening cell (934), and two sides (941) of which are proximate the tail (912) of the two-opening cell (934). A first of two openings (945) is defined between the first refractory anchor (938) and the second refractory anchor (940), a second of two openings (947) is likewise defined between the first (938) and second refractory anchors (940). In certain embodiments of the two-opening cell (934) a mounting element (102) of the second of the two refractory anchors (940) is disposed within the two-opening cell (934). In some embodiments, the mounting element (102) is connected near the intersection of the two sides (943) and extends into the space of the two-opening cell (934). As shown in FIG. 9D, multiple fins may define fin openings (949) between adjacent anchors (938, 940).

Figure 9E:
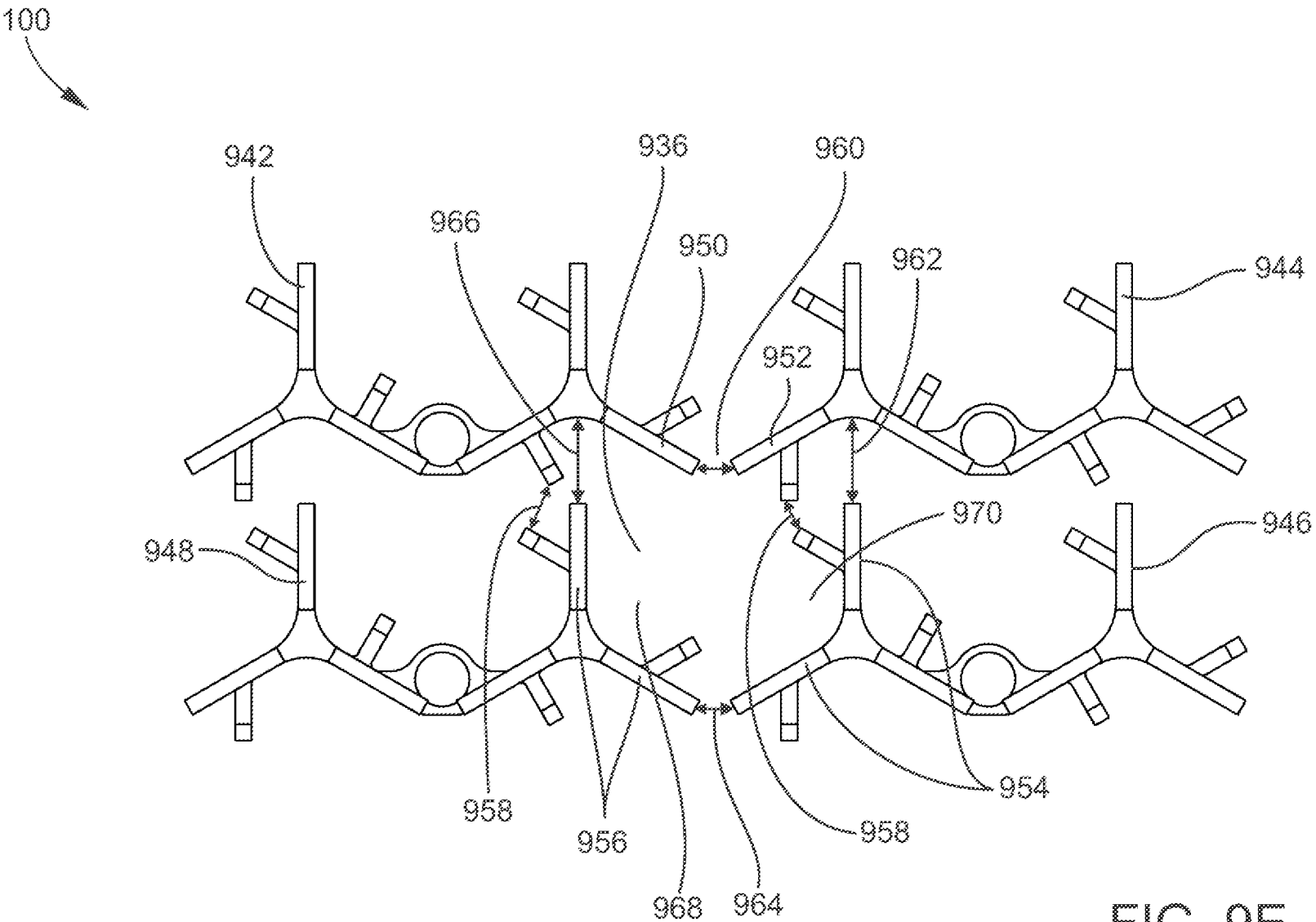

Referring to FIG. 9E, a four-opening cell (936) is formed of a first refractory anchor (942), a second refractory anchor (944), a third refractory anchor (946), and a fourth refractory anchor (948) that are arranged proximate to one another. The first anchor (942) forms side (950) of the four-opening cell (936), the second anchor (944) forms side (952) of the four-opening cell (936), the third anchor (946) forms a third two sides (954) of the four-opening cell (936), and the fourth anchor (948) forms a fourth two sides (956) of the four-opening cell (936). A first of four openings (960) is defined by the first anchor (942) and the second anchor (944), a second opening (962) is defined by the second anchor (944) and the third anchor (946), a third opening (964) is defined by the third anchor (946) and the fourth anchor (948), and a fourth opening (966) is defined by the fourth anchor (948) and the first anchor (942). As shown in FIG. 9E, the four-opening cell (936) does not have a mounting element (102) inside it, or in other words, no mounting element (102) is disposed such that it extends from any anchor into the interior space of the four-opening cell (936). A first shoulder (968) of the four-opening cell (936) is defined proximate the intersection of the two sides (956), and a second shoulder (970) is defined proximate the intersection of the two sides (954).

Figure 10:
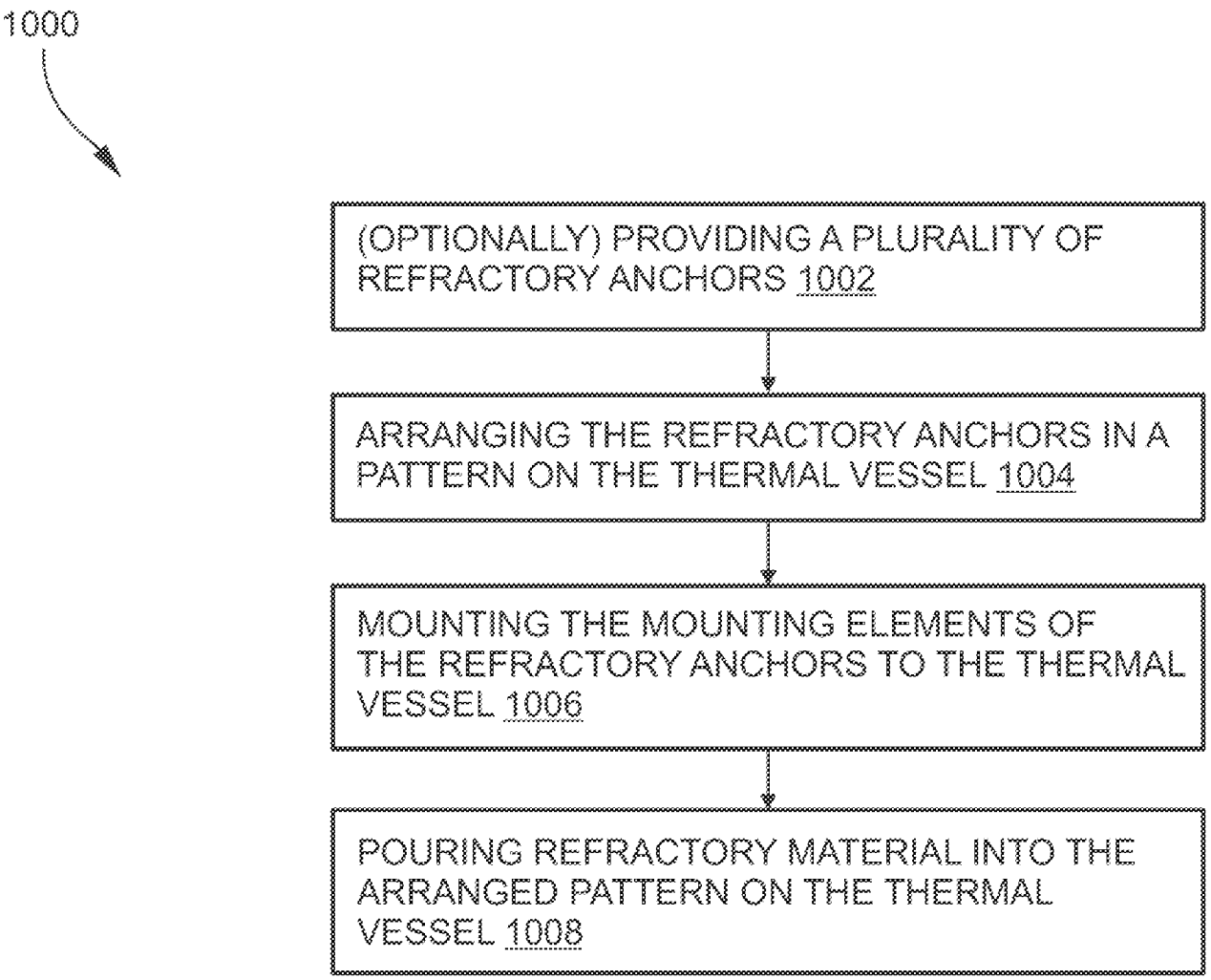
FIG. 10 is a flowchart of a method for installing an anchoring system.

Referring now to FIG. 10, a flowchart illustrates a method (1000) for installing on a thermal vessel an anchoring system of any of the embodiments discussed above. The first step, represented by block (1002), is an optional step to provide the refractory anchors. The second step, represented by block (1004), is to arrange the refractory anchors (100) in a pattern on a thermal vessel. The pattern may be a tessellated pattern (600, 700, 800, 900) discussed herein. The next step, represented by block (1006) is to mount the mounting elements (102) of the refractory anchors (100) to the thermal vessel. The final step, as represented by block (1008) is to pour the refractory material into the arranged patter on the thermal vessel.

The foregoing description provides embodiments of the invention by way of example only. It is envisioned that other embodiments may perform similar functions and/or achieve similar results. Any and all such equivalent embodiments and examples are within the scope of the present invention and are intended to be covered by the appended claims.

What is claimed is:

1. An anchoring system for a refractory material for lining a thermal vessel, the anchoring system comprising:

(a) a plurality of refractory anchors, the refractory anchors each comprising:

(i) a mounting element adapted for mounting the refractory anchor to the thermal vessel;

(ii) two three-anchor fin arrangements that are each directly connected to the mounting element by a first anchor fin positioned in each three-anchor fin arrangement, each first anchor fin directly connected tangentially to a periphery of the mounting element, wherein each three-anchor fin arrangement is positioned on opposite sides of the mounting element relative to one another such that the first anchor fins of each three-anchor fin arrangement are angled ($\alpha$) and non-parallel relative to one another; and (iii) optionally a reinforcement fin connected to and extending away from one of the three-anchor fin arrangements; and (b) wherein the refractory anchors are arranged in an ordered array of hexagonal cells, an array of chevron cells, or a combination thereof in a tessellated pattern forming rows and columns.

2. The anchoring system of claim 1, wherein:

(i) each hexagonal cell is part of a row and a column of the tessellated pattern, (ii) each row comprises a set of co-linear, adjacent hexagonal cells; and (iii) each column comprises a set of co-linear, spaced-apart hexagonal cells.

3. The anchoring system of claim 1, wherein the tessellated pattern is a honeycomb pattern.

4. The anchoring system of claim 1, wherein adjacent rows of the tessellated pattern at least partially overlap one another.

5. The anchoring system of claim 1, wherein adjacent columns of the tessellated pattern at least partially overlap one another.

6. The anchoring system of claim 1, wherein:

(i) each of the three-anchor fin arrangements of each of the plurality of refractory anchors is arranged in a tessellated pattern forming three-anchor fin arrangement rows and three-anchor fin arrangement columns, (ii) the three-anchor fin arrangement rows comprising a set of co-linear, adjacent three-anchor fin arrangements, and (iii) the anchor arrangement columns comprising a set of co-linear, spaced-apart three-anchor fin arrangements.

7. The anchoring system of claim 1, wherein:

(i) each of the three-anchor fin arrangements is arranged in a tessellated pattern forming three-anchor fin arrangement rows and three-anchor fin arrangement columns, (ii) the three-anchor fin arrangement rows comprising a set of co-linear, adjacent three-anchor fin arrangements, and (iii) the anchor arrangement columns comprising a set of co-linear three-anchor fin arrangements from every-other, non-adjacent three-anchor fin arrangement row.

8. The anchoring system of claim 1, wherein each of the mounting elements are arranged in a diagonal tessellated pattern.

9. The anchoring system of claim 1, wherein each of the mounting elements are arranged in a zig-zag tessellated pattern parallel to the columns of the tessellated pattern of the refractory anchors.

10. The anchoring system of claim 1, wherein each of the mounting elements are arranged in a parallelogram tessellated pattern comprising a plurality of adjacent parallelograms.

11. The anchoring system of claim 10, wherein the plurality of adjacent parallelograms comprise similarly-oriented parallelograms, dissimilarly-oriented parallelograms, or both.

12. The anchoring system of claim 1, wherein each of the mounting elements are arranged in a rhomboid tessellated pattern comprising a plurality of adjacent rhomboids.

13. The anchoring system of claim 12, wherein the plurality of adjacent rhomboids comprise similarly-oriented rhomboids, dissimilarly-oriented rhomboids, or both.

14. The anchoring system of claim 1, wherein each hexagonal cell comprises at least three reinforcement fins extending from three-anchor fin arrangements into the hexagonal cell.

15. The anchoring system of claim 1, wherein half of the plurality of hexagonal cells are two-opening cells formed by an arrangement of two refractory anchors proximate one another.

16. The anchoring system of claim 15, wherein:

(i) a first of the two refractory anchors forms two sides of a hexagonal cell, (ii) a second of the two refractory anchors forms four sides of the hexagonal cell, and (iii) two openings are defined between the first refractory anchor and second refractory anchor.

17. The anchoring system of claim 16, wherein a mounting element of the second of the two refractory anchors is disposed within a two-opening cell.

18. The anchoring system of claim 16, wherein two-opening cells form a diagonal tessellated pattern and/or a zig-zag tessellated pattern.

19. The anchoring system of claim 1, wherein half of the plurality of hexagonal cells are three-opening cells formed by an arrangement of three refractory anchors proximate one another.

20. The anchoring system of claim 19, (i) wherein a first of the three refractory anchors forms a first two sides of a three-opening cell, a second of the three refractory anchors forms a second two sides of the three-opening cell, and a third of the three refractory anchors forms a third two sides of the three-opening cell, and (ii) wherein a first of the three openings is defined between the first refractory anchor and the second refractory anchor, a second of the three openings is defined between the second refractory anchor and the third refractory anchor, and a third of the three openings is defined between the third refractory anchor and the first refractory anchor.

21. The anchoring system of claim 19, wherein none of the three-opening cells has a mounting element within the three-opening cell.

22. The anchoring system of claim 19, wherein the three-opening cells form a diagonal tessellated pattern and/or a zig-zag tessellated pattern.

23. The anchoring system of claim 1, wherein:

(i) half of the plurality of hexagonal cells are two-opening cells formed by an arrangement of two refractory anchors proximate one another, and (ii) half of the plurality of hexagonal cells are three-opening cells formed by an arrangement of three refractory anchors proximate one another.

24. The anchoring system of claim 21, wherein:

(i) two-opening cells form a diagonal tessellated pattern and/or a zig-zag tessellated pattern, and (ii) the three-opening cells form a diagonal tessellated pattern and/or a zig-zag tessellated pattern.

* * * * *